US007585813B2

(12) United States Patent
Shimbo et al.

(10) Patent No.: US 7,585,813 B2
(45) Date of Patent: Sep. 8, 2009

(54) REVERSIBLE THERMOSENSITIVE RECORDING MEDIUM, LABEL AND MEMBER, AND IMAGE PROCESSING APPARATUS AND METHOD

(75) Inventors: Hitoshi Shimbo, Shizuoka (JP); Tadafumi Tatewaki, Shizuoka (JP); Shin Yamamoto, Osaka (JP); Kunio Hayakawa, Shizuoka (JP); Shinya Kawahara, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 51 days.

(21) Appl. No.: 11/805,153

(22) Filed: May 21, 2007

(65) Prior Publication Data

US 2007/0225163 A1 Sep. 27, 2007

Related U.S. Application Data

(62) Division of application No. 10/875,012, filed on Jun. 22, 2004, now Pat. No. 7,238,642.

(30) Foreign Application Priority Data

Jun. 25, 2003 (JP) ..... 2003-181661
May 14, 2004 (JP) ..... 2004-144800

(51) Int. Cl.
*B41M 5/42* (2006.01)

(52) U.S. Cl. ..... 503/201; 503/207; 503/226

(58) Field of Classification Search ..... None
See application file for complete search history.

(56) References Cited

U.S. PATENT DOCUMENTS 5,942,377 A 8/1999 Torii et al.
5,981,115 A 11/1999 Furuya et al.
5,981,429 A 11/1999 Kawamura et al.
6,004,899 A 12/1999 Tachizawa
6,090,748 A 7/2000 Furuya et al.
6,154,243 A 11/2000 Tatewaki et al.
6,261,992 B1 7/2001 Furuya et al.
6,579,826 B2 6/2003 Furuya et al.
6,818,591 B2 11/2004 Arai et al.

FOREIGN PATENT DOCUMENTS

JP 55-154198 12/1980
JP 2-188293 7/1990
JP 2-188294 7/1990
JP 3-169590 7/1991
JP 4-224996 8/1992
JP 4-247985 9/1992
JP 4-267190 9/1992

(Continued)

OTHER PUBLICATIONS

Mar. 24, 2009 Japanese official action in connection with a counterpart Japanese patent application No. 2004-144800.

*Primary Examiner*—Bruce H Hess
(74) *Attorney, Agent, or Firm*—Cooper & Dunham, LLP

(57) ABSTRACT

The reversible thermosensitive recording medium according to the present invention comprises a support, a thermosensitive layer and a protective layer in order, the thermosensitive layer comprises an electron-donating coloring compound and an electron-accepting compound and reversibly changes the color depending on temperatures, and the protective layer comprises a reactive heterocyclic compound, and inorganic fine particles of which surface is at least partially treated into hydrophobic, alternatively the protective layer comprises inorganic fine particles of which number-average particle size is 100 nm or less and of which surface is at least partially coated with organic silane compounds.

23 Claims, 14 Drawing Sheets

FOREIGN PATENT DOCUMENTS

| | | |
|---|---|---|
| JP | 5-24353 | 2/1993 |
| JP | 5-124360 | 5/1993 |
| JP | 5-208555 | 8/1993 |
| JP | 5-221129 | 8/1993 |
| JP | 6-210954 | 8/1994 |
| JP | 8-175012 | 7/1996 |
| JP | 9-226256 | 9/1997 |
| JP | 10-264521 | 10/1998 |
| JP | 11-157212 | 6/1999 |
| JP | 11-268419 | 10/1999 |
| JP | 2000-177253 | 6/2000 |
| JP | 3194398 | 6/2001 |
| JP | 2001-301331 | 10/2001 |
| JP | 2001-315367 | 11/2001 |
| JP | 2002-178647 | 6/2002 |
| JP | 3315831 | 6/2002 |
| JP | 2002-248859 | 9/2002 |
| JP | 2002-307829 | 10/2002 |
| JP | 2003-118235 | 4/2003 |
| JP | 2003-145933 | 5/2003 |

Rewritable Display Part

Bar Code Printing no RF-ID tag

REVERSIBLE THERMOSENSITIVE RECORDING MEDIUM, LABEL AND MEMBER, AND IMAGE PROCESSING APPARATUS AND METHOD

CROSS-REFERENCE TO RELATED APPLICATION

This application is a divisional of U.S. Ser. No. 10/875,012, flied Jun. 22, 2004, now U.S. Pat. No. 7,238,642 the entire contents of which are herein incorporated by reference.

BACKGROUND

1. Technical Field

This disclosure relates to a reversible thermosensitive recording medium in which color images may be formed and erased reversibly based on color-developing reactions between electron-donating coloring compounds and electron-accepting compounds by controlling applied thermal energies, and also relates to a reversible thermosensitive recording label, a reversible thermosensitive recording member, an image processing apparatus and a process which employ the reversible thermosensitive recording medium respectively.

2. Description of the Related Art

Previously, thermosensitive recording media which utilize reactions between electron-donating coloring compounds (hereinafter, sometimes referred as "coloring agent") and electron-accepting compounds (hereinafter, sometimes referred as "color developer") are well-known, and have been broadly utilized as output papers of facsimiles, word processors and scientific instrumentation apparatuses, with an advance of office automation, and nowadays in magnetic thermosensitive cards such as a pre-paid card and point card.

However, since such thermosensitive recording media are irreversible and disposable after their usages, an environmental issue has been derived. Accordingly, from the nowadays view point on recycle, a reversible thermosensitive recording composition and reversible thermosensitive recording medium that employ a composition in the thermosensitive layer is proposed, in which an organic phosphorus compound containing a long-chain fatty hydrocarbon group, fatty carbonyl acid compound, or phenol compound as a developing agent is combined with a leuco dye as a color former (see Japanese Patent Application Laid-Open (JP-A) No. 5-124360). Also a reversible thermosensitive recording composition is proposed, in which a phenol compound of certain structure having a long-chain fatty hydrocarbon group is employed as a developing agent (see JP-A No. 6-210954).

However, when printing and erasing are repeatedly carried out on the reversible thermosensitive recording media in the actual condition, such problems may appear as decrease of image density, blowing trace, flaw, and erasing remainder. Consequently, the excellent developing-erasing properties owing to the coloring agent and color developer incorporated in the reversible thermosensitive recording media have not been sufficiently demonstrated.

In order to resolve these problems concerning the reversible thermosensitive recording media, such an approach was made from the mechanical standpoint that the load on the recording face should be as low as possible. For example, a means for increasing the resistivity is proposed in which the smear is removed by water or cleaning solution in the erasing step (see JP-A No. 2001-301331); and an erasing process was proposed in which a photothermo-transverse tape is utilized (see Japanese Patent (JP-B) No. 3194398, JP-A No. 2001-315367).

However, there arise some difficulties in these proposals such as additional consumables are required, and the instruments come to complex and expensive.

As a result, an improved durability is required in the reversible thermosensitive recording medium itself, for example, the addition of silica is proposed of which the surface is treated with an organic silane compound (see JP-B No. 3315831). However, in the proposal, such matters appear that the erasing remainder does not decrease to a satisfactory level along with the repeated printing-erasing, and crazings occur on the printed areas.

Further, similar proposal have been made in which a pigment with surface treatment is added to one of the thermosensitive layer, protective layer and anchor layer (see JP-A No. 10-264521). However, when the pigment with surface treatment is added to the protective layer, the distortion caused by repeated printings may not be eliminated thereby crazings may be induced. On the other hand, when the pigment with surface treatment is added to the thermosensitive layer and anchor layer, such deficiencies arise that the image clearness comes to down, and the images turn to obscure.

As aforementioned, the reversible thermosensitive recording media have not been attained yet, which are free of image degradation due to mechanical damages even after the repeated recording and erasing. Accordingly, such improvements for the reversible thermosensitive recording media are demanded as soon as possible.

SUMMARY

The object of the present invention is to provide There is provided in an exemplary embodiment of this disclosure a reversible thermosensitive recording medium, in which image degradation due to mechanical damages on the surface may be avoided even after the repeated usage for recording and erasing, and reversible thermosensitive recording label, reversible thermosensitive recording member, and image processing apparatus and process which employ the reversible thermosensitive recording medium.

In the first aspect, the recording medium according to the present invention comprises a support, a thermosensitive layer and a protective layer in order, the thermosensitive layer comprises an electron-donating coloring compound and an electron-accepting compound and reversibly changes the color depending on temperatures, and the protective layer comprises a reactive heterocyclic compound, and inorganic fine particles of which surface is at least partially treated into hydrophobic.

In the reversible thermosensitive recording medium, the protective layer comprises a reactive heterocyclic compound, and inorganic fine particles of which surface is at least partially treated into hydrophobic, thereby the durability at the printing area may be remarkably increased, and such occurrences due to repeated printings may be prevented as a blowing trace, background smear, crazing, scratch and erasing remainder.

In the second aspect, the recording medium according to the present invention comprises a support, a thermosensitive layer and a protective layer in order, the thermosensitive layer comprises an electron-donating coloring compound and an electron-accepting compound and reversibly changes the color depending on temperatures, and the protective layer comprises inorganic fine particles of which number-average particle size is 100 nm or less and of which surface is at least partially treated into hydrophobic.

In the reversible thermosensitive recording medium, the protective layer comprises inorganic fine particles of which number-average particle size is 100 nm or less and of which surface is at least partially treated into hydrophobic, thereby the durability at the printing area may be remarkably increased, and such occurrences due to repeated printings may be prevented as a blowing trace, background smear, crazing, scratch and erasing remainder.

The reversible thermosensitive recording label according to the present invention comprises one of the adhesive layer and tacky layer disposed on the surface opposite to the image forming side of the recording medium of the above-noted first and second aspects according to the present invention.

The recording label may exhibit suitable coloring densities, being adapt to rapid erasing by a thermal head, and represents superior properties on erasing remainder after repeated printings and durability at printing areas. In addition, owing to the adhesive layer or tacky layer, the recording label may be broadly applied to, for example, a thicker substrate such as a card formed of polyvinyl chloride with magnetic stripe to which the direct coating of thermosensitive layer is difficult, container of sheet size larger than card size, sticker, and wide screen.

The reversible thermosensitive recording member comprises an information-memorizing part and a reversible displaying part, the reversible displaying part comprises the reversible thermosensitive recording medium of the first or the second aspect according to the present invention. In the recording member, the protective layer in the reversible displaying part comprises a reactive heterocyclic compound, and inorganic fine particles of which surface is at least partially treated into hydrophobic, thereby the erasing remainder due to repeated printings and the durability at the printing area may be remarkably improved. Therefore, images with superior contrast, visuality and the like may be formed.

On the other hand, at the information-memorizing part, various optional information such as of letter, image, music, and picture are recorded and erased through the corresponding way with the recording means of magnetic thermosensitive layer, magnetic stripe, IC memory, optical memory, hologram, RF-ID tag card, disc, disc cartridge and tape cassette.

The image processing apparatus comprises at least one of an image forming unit and an image erasing unit, wherein images are formed on the reversible thermosensitive recording medium of the first or the second aspect according to the present invention.

In the image forming apparatus, the image forming unit forms images on the recording medium of the first or the second aspect according to the present invention by heating the recording medium. On the other hand, the image erasing unit erases images on the recording medium of the first or the second aspect according to the present invention by heating the recording medium.

The image processing apparatus comprises the reversible thermosensitive recording medium according to the present invention as the recording medium, thereby the repetition durability may be remarkably increased to provide rewritable recording with high practicability.

The image processing method may achieve at least one of image forming and image erasing through heating the recording medium of the first or the second aspect according to the present invention. In the image processing method, images are formed on the recording medium by heating the recording medium. On the other hand, images formed on the recording medium are erased through heating the recording medium. In the image processing method, the reversible thermosensitive recording medium according to the present invention is employed as the recording medium, thereby images may be formed with high coloring densities without the occurrences of erasing remainder, background smear, crazing and blowing trace due to repeated printings.

Figure 1:
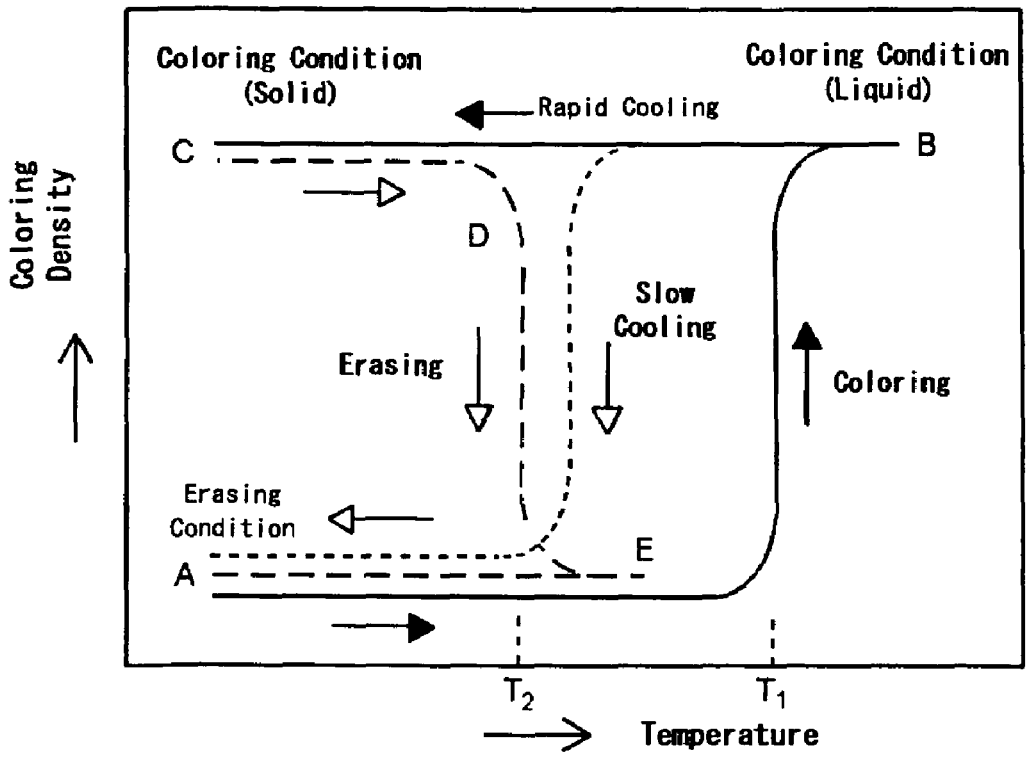
FIG. 1 schematically shows the color developing-reducing property (developing-erasing phenomena) in an example of the reversible thermosensitive recording medium according to the present invention.

DESCRIPTION OF THE PREFERRED EMBODIMENTS (Reversible Thermosensitive Recording Medium)

The reversible thermosensitive recording medium according to the present invention comprises a support, and at least a thermosensitive layer and a protective layer on the support, and also may optionally comprise an intermediate layer and the other layers.

<Support>

The support is not restricted as to the shape, configuration, size and the like and may be properly selected depending on the application; for example, the shape may be plate-like, the configuration may be of single layer, and the size may be properly selected depending on the size of the reversible thermosensitive recording medium and the like.

The material of the support may be inorganic or organic. Examples of the inorganic material include, but are not limited to, glass, quartz, silicon, silicon oxide, aluminum oxide, $SiO_2$ and metal. Examples of the organic material include, but are not limited to, paper, cellulose derivatives such as triacetyl cellulose, synthetic paper, polyethylene terephthalate, polycarbonate, polystyrene, and polymethylmethacrylate. These may be used alone or in combination.

Among these materials, polyethylene terephthalate and PET-G film, having a haze level of 10% or less (haze, defined in JISK7105) as the support itself, are particularly preferred so as to obtain a sheet with highly clear images.

The support is preferably subjected to surface reforming by means of corona discharge processing, oxidation reaction processing (by chromium oxide etc.), etching processing, adherable processing or anti-static processing. Further, the support is preferably rendered to white by being incorporated white pigment such as titanium oxide and the like.

The thickness of the support may be properly selected depending on the application without particular limitations; preferably the thickness is 10 to 2000 μm, more preferably 20 to 1000 μm.

The support may bear a magnetic thermosensitive layer on at least one of the same and opposite sides with the thermosensitive layer. Further, the reversible thermosensitive recording medium according to the present invention may be laminated to the other media through a tacky layer and the like.

<Thermosensitive Layer>

The thermosensitive layer may reversibly change the color depending on the temperatures. The thermosensitive layer comprises an electron-donating coloring compound and an electron-accepting compound, and also a decoloring enhancer, binder resin and the other ingredients depending on the necessity.

The above-noted "reversibly change the color depending on the temperature" means a phenomenon in which visible changes are induced reversibly depending on the temperature alternation, in other words, it means that a relatively developed condition and a relatively erased condition may be produced depending on the heating temperatures and/or cooling rates following to heating. In this meaning, the visible change may include the change of color condition as well as the change of shape. In the present invention, the materials that may cause the changes of color condition are mainly utilized.

The changes of color condition include the changes of transmittance, reflectivity, absorption wavelength, and scattering coefficient. Actual reversible thermosensitive recording media are expressed by the combination of these changes. Specifically, such materials are also exemplified that the first color condition appears at the first temperature above ambient temperature, and the second color condition appears when heated to the second temperature above the first temperature then cooled, i.e. any materials may be utilized provided that the transparency and/or color may change depending on the temperature. Among various materials, the materials that change the color condition at the first specific temperature and at the second specific temperature are preferably utilized.

As such materials, the material that is transparent at the first temperature and white opaque at the second temperature (JP-A No. 55-154198), the material that develops a color at the second temperature and erases at the first temperature (JP-A No. 04-224996, JP-A No. 04-247985, JP-A No. 04-267190 etc.), the material that is white opaque at the first temperature and is transparent at the second temperature (JP-A No. 03-169590 etc.), the material that develops black, red, blue etc. and erases at the second temperature (JP-A No. 02-188293, JP-A No. 02-188294 etc.) may be exemplified.

As discussed above, the reversible thermosensitive recording medium according to the present invention may represent a relatively colored condition and a relatively erased condition depending on the heating temperature and/or cooling rate following to the heating.

The essential color developing-erasing phenomenon of the composition, which includes the coloring agent and color developer, will be discussed in the following. FIG. 1 shows the relation between the coloring density and the temperature in the reversible thermosensitive recording medium. When the recording medium is heated from the initial erased condition (A), the recording medium comes to the melted and developed condition (B), through an occurrence of developing at the temperature T1 at which the melting begins. When cooled rapidly from the melted and developed condition (B), it may be cooled to the room temperature while maintaining the developed condition, thereby a fixed and developed condition (C) emerges. Whether or not the developed condition emerges depends on the cooling rate from the melted condition; the erasing appears when cooled slowly, that is, the initial erased condition (A) or lower density than rapid cooling (C) emerges. On the other hand, when heated again from rapidly cooled coloring condition (C), erasing occurs at a lower temperature T2 than the developing temperature (D to E); when cooled from the temperature, resulting in the initial erased condition (A). Actual developing and erasing temperatures may be selected depending on the application since these temperatures vary with the utilized coloring agent and color developer. Further, the coloring density at the melting condition and the coloring density after the rapid cooling may not necessarily coincide, are different significantly in some cases.

In the recording medium, the coloring condition (C) obtained through rapid cooling from the melted condition is a condition in which the coloring agent and color developer are blended such that they may react through molecular contact, and the coloring condition is often solid state. In the condition, the coloring agent and color developer are coagulated to represent a coloring condition. It is believed that the formation of the coagulated condition makes the coloring condition stable. On the other hand, in the erased condition, the coloring agent and color developer are in phase separation. It is believed that the molecules of at least one of the compounds assemble to form domains or crystals in the separated condition, and that the coloring agent and color developer are separated and stabilized through the coagulation or crystallization.

In many cases, the phase separation of the coloring agent and the color developer and also the crystallization of the color developer cause the erasion more perfectly. In the erasion due to slower cooling from the melted condition as well as the erasion due to the heating from the coloring condition as shown in FIG. 1, the coagulated structures are altered depending on the temperatures, resulting in the phase separation and/or crystallization of the color developer.

In the recording medium, the developed recording may be formed by heating up to the temperature for melting and mixing by means of a thermal head and the like, then subjecting to a rapid cooling.

Further, the erasion may be carried out in two ways; one is to cool slowly from the heated condition, the other is to heat to somewhat lower temperature than the coloring temperature. The two ways are equivalent in that the coloring agent and color developer come to phase separation or they are maintained at the temperature at which at least one of the coloring agent and color developer crystallizes.

The rapid cooling in the formation of the coloring condition is intended not to maintain at the phase-separation or crystallization temperature. By the way, the terms of "rapid" and "slow" cooling represent no more than relative cooling rates with respect to certain composition, and the actual rates alter depending on the combination of the coloring agent and color developer.

—Electron-Accepting Compound—

The electron-accepting compound (color developer) may be properly selected depending on the application without particular limitations, provided that the coloring and erasing may be induced reversibly depending on the temperature as an intentional variable factor. For example, the compounds are preferred having in the molecule one or more structure selected from (i) the structure which affords developing ability for developing electron-donating coloring compounds (coloring agent) (e.g. phenol type hydroxy group, carboxyl acid group, phosphoric acid group etc.), and (ii) the structure which controls the cohesive property between molecules (the structure with connected long-chain hydrocarbon groups). Further, the connected portions may be intervened by the connecting groups with hetero atom having two or more valence, and the long-chain hydrocarbon group may contain such connecting group and/or aromatic group. Among these compounds, the phenol compound expressed by the following formula (1) is particularly preferred.

Formula (1)

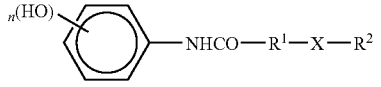

wherein "n" represents an integral number of 1 to 3; "X" represents an organic group of two valence containing nitrogen and/or oxygen atom; $R^1$ and $R^2$ respectively represent fatty hydrocarbon groups which may be still substituted with other groups.

"$R^1$" represents a fatty hydrocarbon group, which may be still substituted with other groups, of which carbon atoms are two or more, preferably five or more in particular.

"$R^2$" represents a fatty hydrocarbon group, which may be still substituted with other groups, of which carbon atoms are 2 to 24, preferably 8 to 18.

The fatty hydrocarbon group may be liner or branched, may include an unsaturated bonding. The substituent which bonds to the hydrocarbon group may be hydroxy group, halogen atom, alkoxy group and the like. When the sum of the carbon atoms in $R^1$ and $R^2$ is 7 or less, the developing stability and erasing property are not sufficient, therefore the sum of carbon atoms is preferably 8 or more, more preferably 11 or more.

As for "$R^1$" the followings may be suitably exemplified.

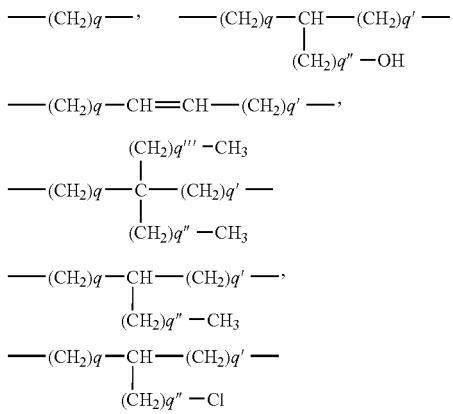

wherein the q, q', q", and q''' indicate the integral numbers that satisfy the carbon atom number in $R^1$ and $R^2$. Among these, particularly preferable is $—(CH_2)_q—$.

As for "$R^2$" the followings may be suitably exemplified.

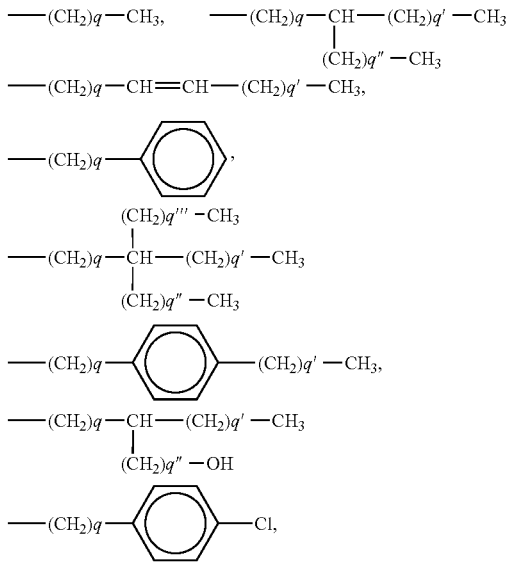

wherein the q, q', q", and q''' indicate the integral numbers that satisfy the carbon atom number in $R^1$ and $R^2$. Among these, particularly preferable is $—(CH_2)_q—CH_3$.

The "X" represents a divalent organic group containing nitrogen and/or oxygen atom, and exemplified by the divalent groups containing at least one group expresses by the following formulae.

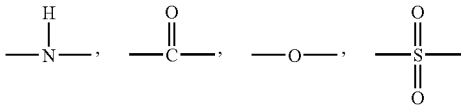

As for the divalent organic group, the following formulae may be suitably exemplified.

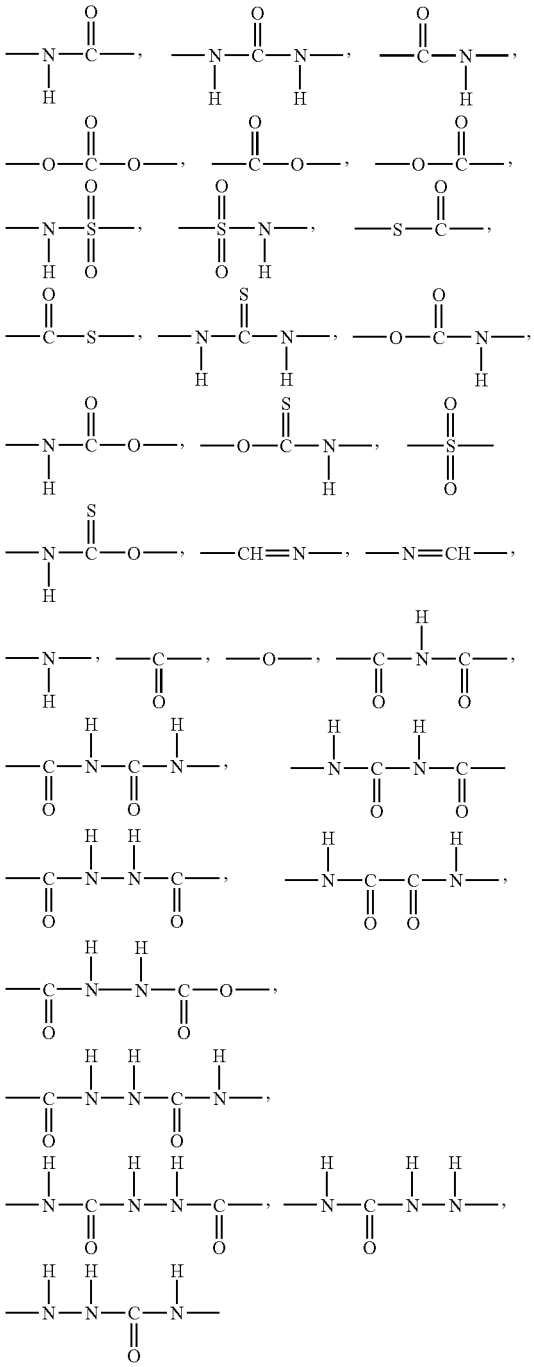

Among these, particularly preferred groups are exemplified by the following formulae.

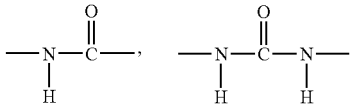

As for the phenol compounds expressed by the formula (1), the compounds expressed by the following formulae (2) and (3) may be suitably exemplified.

Formula (2)

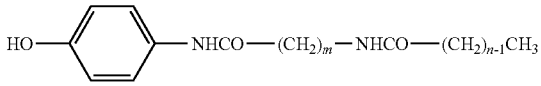

Formula (3)

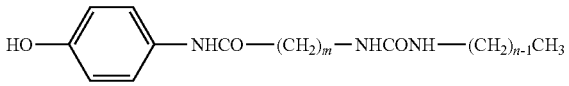

wherein "m" in the formulae (2) and (3) represent the number of 5 to 11, "n" represents 8 to 22.

The concrete examples expressed by the formulae (2) and (3) will be shown in the following.

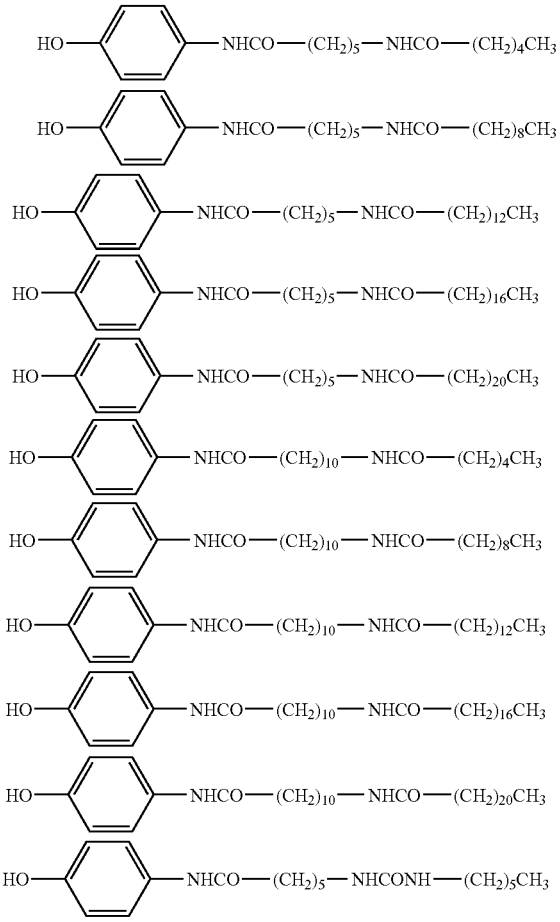

-continued

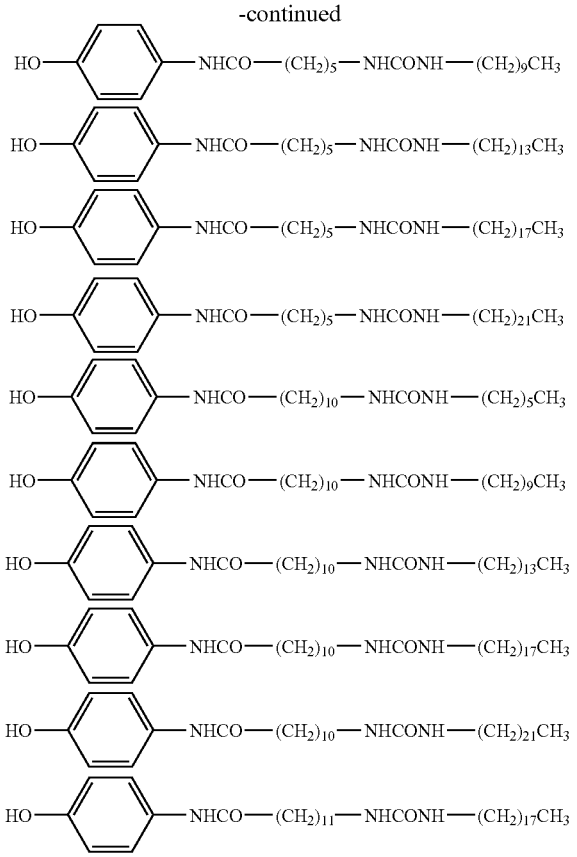

—Electron-Donating Coloring Compounds—

The electron-donating coloring compounds (coloring agent) may be suitably selected depending on the application without particular limitations; leuco dyes are preferably exemplified for example.

As for the leuco dyes, fluoran and azaphthalide compounds are preferred, for example, the following compounds:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-n-isoamyl-N-ethylamino)fluoran,
2-anilino-3-methyl-6-(N-n-propyl-N-isopropylamino)-fluoran,
2-anilino-3-methyl-6-(N-cyclohexyl-N-methylamino)-fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino)fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran, 3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide, and
3,3-bis(2-ethoxy-4-diethylaminophenyl)-7-azaphthalide.

The electron-donating coloring compounds (coloring agent) may include conventional leuco dyes other than the above-noted fluoran and azaphthalide compounds, for example, 2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran, 2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran, and
1,2-benzo-6-(N-ethyl-N-toluidino)fluoran may be exemplified.

These may be used alone or in combination. Further, the condition of multi-color or full-color may be presented by means of laminating a plurality of layers that develop in the various tonalities.

The blending ratio of the electron-donating coloring compound (coloring agent) and electron-accepting compound (color developer) is not limited definitely, since the appropriate range is different depending on the utilized compounds. Preferably, the mol ratio of the color developer based on the coloring agent is 0.1 to 20, more preferably 0.2 to 10. The color developer amount of over or under this range may result in a lower coloring density. Further, the coloring agent and color developer may be utilized in an encapsulated condition.

—Erasure Promoter—

When the color developer is combined with a compound intended for an erasure promoter, which comprise at least one of amide group, urethane group, and urea group, the erasing rate may be remarkably enhanced, since an interaction comes to be induced between the molecules of the erasure promoter and color developer.

The erasure promoter may be such compounds that comprise at least one of amide group, urethane group, and urea group. In particular, the compounds expressed by the following formulae are preferred.

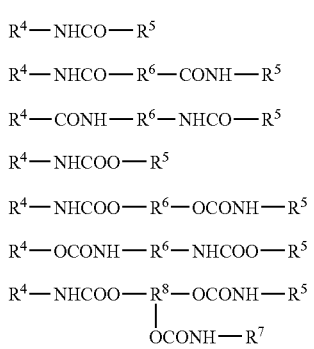

Formula (4)
Formula (5)
Formula (6)
Formula (7)
Formula (8)
Formula (9)
Formula (10)

wherein $R^4$, $R^5$, and $R^7$ in the formulae (4) to (10) represent linear alkyl group, branched alkyl group or unsaturated alkyl group having 7 to 22 carbon atoms. $R^6$ represents a divalent functional group having 1 to 10 carbon atoms. $R^8$ represents a trivalent functional group having 4 to 10 carbon atoms.

Examples of $R^4$, $R^5$, and $R^7$ include heptyl, octyl, nonyl, decyl, undecyl, dodecyl, stearyl, behenyl, and oleyl groups.

Examples of $R^6$ include methylene, ethylene, propylene, buthylene, heptamethylene, hexamethylene, and octamethylene groups Preferably, $R^8$ is those expressed by the following formulae.

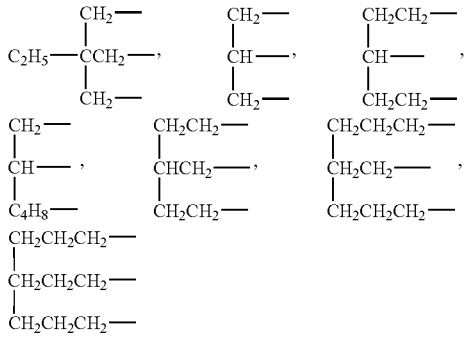

The concrete examples of the compounds expressed by the formulae (4) to (10) preferably include the following compounds expressed by (1) to (81).

(1) $C_{11}H_{23}CONHC_{12}H_{25}$ (2) $C_{15}H_{31}CONHC_{16}H_{33}$ (3) $C_{17}H_{35}CONHC_{18}H_{37}$ (4) $C_{17}H_{35}CONHC_{18}H_{35}$ (5) $C_{21}H_{41}CONHC_{18}H_{37}$ (6) $C_{15}H_{31}CONHC_{18}H_{37}$ (7) $C_{17}H_{35}CONHCH_2NHCOC_{17}H_{35}$ (8) $C_{11}H_{23}CONHCH_2NHCOC_{11}H_{23}$ (9) $C_7H_{15}CONHC_2H_4NHCOC_{17}H_{35}$

(10) $C_9H_{19}CONHC_2H_4NHCOC_9H_{19}$

(11) $C_{11}H_{23}CONHC_2H_4NHCOC_{11}H_{23}$

(12) $C_{17}H_{35}CONHC_2H_4NHCOC_{17}H_{35}$

(13) $(CH_3)_2CHC_{14}H_{35}CONHC_2H_4NHCOC_{14}H_{35}(CH_3)_2$

(14) $C_{21}H_{43}CONHC_2H_4NHCOC_{21}H_{43}$

(15) $C_{17}H_{35}CONHC_6H_{12}NHCOC_{17}H_{35}$

(16) $C_{21}H_{43}CONHC_6H_{12}NHCOC_{21}H_{43}$

(17) $C_{17}H_{33}CONHC_2NHCOC_{17}H_{33}$

(18) $C_{17}H_{33}CONHC_2H_4NHCOC_{17}H_{33}$

(19) $C_{21}H_{41}CONHC_2H_4NHCOC_{21}H_{41}$

(20) $C_{17}H_{33}CONHC_6H_{12}NHCOC_{17}H_{33}$

(21) $C_8H_{17}NHCOC_2H_4CONHC_{18}H_{37}$

-continued

(22) $C_{10}H_{21}NHCOC_2H_4CONHC_{10}H_{21}$

(23) $C_{12}H_{25}NHCOC_2H_4CONHC_{12}H_{25}$

(24) $C_{18}H_{37}NHCOC_2H_4CONHC_{18}H_{37}$

(25) $C_{21}H_{43}NHCOC_2H_4CONHC_{21}H_{43}$

(26) $C_{18}H_{37}NHCOC_6H_{12}CONHC_{18}H_{37}$

(27) $C_{18}H_{35}NHCOC_4H_8CONHC_{18}H_{35}$

(28) $C_{18}H_{35}NHCOC_8H_{16}CONHC_{18}H_{35}$

(29) $C_{12}H_{25}OCONHC_{18}H_{37}$

(30) $C_{13}H_{27}OCONHC_{18}H_{37}$

(31) $C_{16}H_{33}OCONHC_{18}H_{37}$

(32) $C_{18}H_{37}OCONHC_{18}H_{37}$

(33) $C_{21}H_{43}OCONHC_{18}H_{37}$

(34) $C_{12}H_{25}OCONHC_{16}H_{33}$

(35) $C_{13}H_{27}OCONHC_{16}H_{33}$

(36) $C_{16}H_{33}OCONHC_{16}H_{33}$

(37) $C_{18}H_{37}OCONHC_{16}H_{33}$

(38) $C_{21}H_{43}OCONHC_{16}H_{33}$

(39) $C_{12}H_{25}OCONHC_{14}H_{29}$

(40) $C_{13}H_{27}OCONHC_{14}H_{29}$

(41) $C_{16}H_{33}OCONHC_{14}H_{29}$

(42) $C_{18}H_{37}OCONHC_{14}H_{29}$

(43) $C_{22}H_{45}OCONHC_{14}H_{29}$

(44) $C_{12}H_{25}OCONHC_{12}H_{37}$

(45) $C_{13}H_{27}OCONHC_{12}H_{37}$

(46) $C_{16}H_{33}OCONHC_{12}H_{37}$

(47) $C_{18}H_{37}OCONHC_{12}H_{37}$

(48) $C_{21}H_{43}OCONHC_{12}H_{37}$

(49) $C_{22}H_{45}OCONHC_{18}H_{37}$

(50) $C_{18}H_{37}NHCOOC_2H_4OCONHC_{18}H_{37}$

(51) $C_{18}H_{37}NHCOOC_3H_6OCONHC_{18}H_{37}$

(52) $C_{18}H_{37}NHCOOC_4H_8OCONHC_{18}H_{37}$

(53) $C_{18}H_{37}NHCOOC_6H_{12}OCONHC_{18}H_{37}$

(54) $C_{18}H_{37}NHCOOC_8H_{16}OCONHC_{18}H_{37}$

(55) $C_{18}H_{37}NHCOOC_2H_4OC_2H_4OCONHC_{18}H_{37}$

(56) $C_{18}H_{37}NHCOOC_3H_6OC_3H_6OCONHC_{18}H_{37}$

-continued

(57) $C_{18}H_{37}NHCOOC_{12}H_{24}OCONHC_{18}H_{37}$

(58) $C_{18}H_{37}NHCOOC_2H_4OC_2H_4OC_2H_4OCONHC_{18}H_{37}$

(59) $C_{16}H_{33}NHCOOC_2H_4OCONHC_{16}H_{33}$

(60) $C_{16}H_{33}NHCOOC_3H_6OCONHC_{16}H_{33}$

(61) $C_{16}H_{33}NHCOOC_4H_8OCONHC_{16}H_{33}$

(62) $C_{16}H_{33}NHCOOC_6H_{12}OCONHC_{16}H_{33}$

(63) $C_{16}H_{33}NHCOOC_8H_{16}OCONHC_{16}H_{33}$

(64) $C_{18}H_{37}OCOHNC_6H_{12}NHCOOC_{18}H_{37}$

(65) $C_{16}H_{33}OCOHNC_6H_{12}NHCOOC_{16}H_{33}$

(66) $C_{14}H_{29}OCOHNC_6H_{12}NHCOOC_{14}H_{29}$

(67) $C_{12}H_{25}OCOHNC_6H_{12}NHCOOC_{12}H_{25}$

(68) $C_{10}H_{21}OCOHNC_6H_{12}NHCOOC_{10}H_{21}$

(69) $C_8H_{17}OCOHNC_6H_{12}NHCOOC_8H_{17}$ (70)

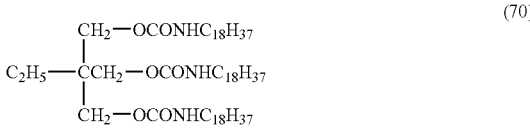

(71)

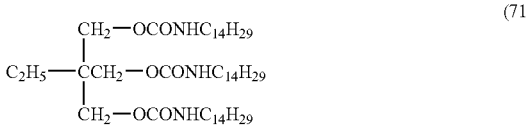

(72)

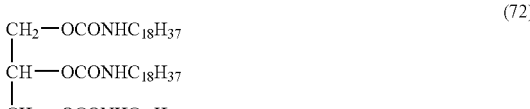

(73)

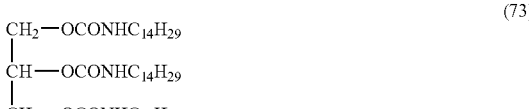

(74)

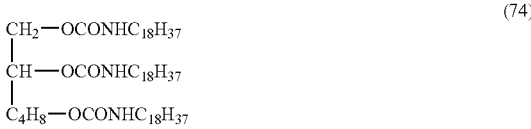

(75)

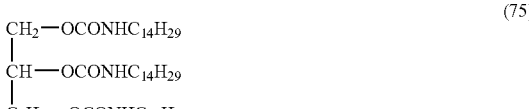

(76)

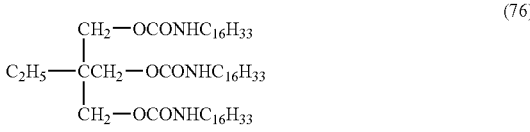

(77)

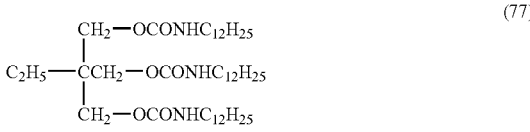

-continued (78)

$$\begin{array}{l} CH_2-OCONHC_{16}H_{33} \\ | \\ CH-OCONHC_{16}H_{33} \\ | \\ CH_2-OCONHC_{16}H_{33} \end{array}$$

(79)

$$\begin{array}{l} CH_2-OCONHC_{12}H_{25} \\ | \\ CH-OCONHC_{12}H_{25} \\ | \\ CH_2-OCONHC_{12}H_{25} \end{array}$$

(80)

$$\begin{array}{l} CH_2-OCONHC_{16}H_{33} \\ | \\ CH-OCONHC_{16}H_{33} \\ | \\ C_4H_8-OCONHC_{16}H_{33} \end{array}$$

(81)

$$\begin{array}{l} CH_2-OCONHC_{12}H_{25} \\ | \\ CH-OCONHC_{12}H_{25} \\ | \\ C_4H_8-OCONHC_{12}H_{25} \end{array}$$

The loading of the erasure promoter is preferably 0.1 to 300 parts by mass, more preferably 3 to 100 parts by mass based on 100 parts by mass of the color developer. When the loading is less than 0.1 parts by mass, the effect by the added erasure promoter may not be achieved, on the other hand, when over 300 parts by mass, the coloring density may be low.

In the thermosensitive layer, binder resins as well as various additives may be incorporated in order to improve and/or control the coating and/or color erasing properties depending on the requirements. Examples of such additives include crosslinker, crosslinking promoter, filler, lubricant, surfactant, conducting agent, loading material, antioxidant, solar proof material, color stabilizer, plasticizer and the like.

The binder resin may be properly selected depending on the application without particular limitations; examples of the binder resin include polyvinyl chloride resins, polyvinyl acetate resins, vinylchloride-vinylacetate copolymers, ethylcellulose, polystyrene resins, styrene copolymers, phenoxy resins, polyester resins, aromatic polyester resins, polyurethane resins, polycarbonate resins, polyester acrylate resins, polyester methacrylate, acryl copolymers, maleic acid copolymers, polyvinylalcohol resins, modified polyvinylalcohol resins, hydroxylethylcellulose, carboxymethylcellulose, and starch.

These binder resins serve to prevent the deviation of the respective materials in the composition due to heating for the recording erasures thereby to maintain the uniformly dispersed condition. Accordingly, the binder resin is preferred to be highly heat-resistant. Further, the binder resin is preferred to be crosslinked resin hardened by means of crosslinker as well as heating, ultra-violet irradiation, electron beam and the like (hereinafter, sometimes "crosslinked resins"). The incorporation of crosslinked resin into the thermosensitive layer may enhance the heat-resistance and coating strength of the thermosensitive layer, and may improve the repetition durability.

The curable resin may be properly selected depending on the application without particular limitations; examples of the curable resin include such resins, having a group reactive with a crosslinker, as acrylpolyol resins, polyesterpolyol resins, polyurethanepolyol resins, phenoxy resins, polyvinylbutyral resins, celluloseacetate propionate resins, and celluloseacetate butyrate resins, and also the other copolymer resins between a monomer having a group reactive with a crosslinker and another monomer. Among these resins, acrylpolyol resins, polyesterpolyol resins and polyurethanepolyol resins are preferred.

The hydroxyl value of the curable resins is preferably 70 KOHmg/g or more, more preferably 90 KOHmg/g or more, thereby the durability, surface hardness of the coating, and cracking resistance may be enhanced. The level of the hydroxyl value is related to the crosslinking density; therefore it affects the chemical resistance of the coating and the like.

The acrylpolyol resin may be prepared in the conventional process such as solution polymerization, suspension polymerization and emulsion polymerization from acrylic ester monomers or methacrylic ester monomers and unsaturated monomers having carboxyl group, hydroxyl group and others. Examples of the unsaturated monomer having carboxyl group include hydroxyethylacrylate (HEA), hydroxypropylacrylate (HPA), 2-hydroxyethylmethacrylate (HEMA), 2-hydroxypropylmethacrylate (HPMA), 2-hydroxybutylmonoacrylate (2-HBA), and 1,4-hydroxybutylmonoacrylate (1-HBA).

Among these monomers, the monomer having a primary hydroxyl group such as 2-hydroxyethylmethacrylate is suitably utilized, in light of superior cracking resistance and durability of the coating.

The crosslinker may be selected from conventional isocyanate compounds, amine compounds, phenol compounds, epoxy compounds and the like. Among these compounds, isocyanate compound is particularly preferable. The isocyanate compound may be properly selected depending on the application without particular limitations, and the examples include various derivatives of isocyanate monomer such as urethane-modified, allophanate-modified, isocyanurate-modified, buret-modified, and carbodiimide-modified compounds, and blockedisocyanate compounds.

Examples of the isocyanate monomer, which may yield the above-noted modified compounds, include tolylenediisocyanate (TDI), 4,4'-diphenylmethanediisocyanate (MDI), xylylenediisocyanate (XDI), naphthylenediisocyanate (NDI), paraphenylenediisocyanate (PPDI), tetramethylxylylenediisocyanate (TMXDI), hexamethylenediisocyanate (HDI), dicyclohexylmethanediisocyanate (HMDI), isophoronediisocyanate (IPDI), lysinediisocyanate (LDI), isopropylidenebis(4-cyclohexylisocyanate) (IPC), cyclohexyldiisocyanate (CHDI), and tolidinediisocyanate (TODI).

As the crosslinking promoter, a catalyst may be employed which is utilized in general for such reaction. Examples of the crosslinking promoter include tertiary amines such as 1,4-diaza-bicyclo(2,2,2)octane, and metal compounds such as organic tin compounds. Further, all of the introduced crosslinker may not necessarily react for the crosslinking. That is, the crosslinker may be remained in unreacted condition. Such crosslinking reaction may progress with time; therefore, the presence of unreacted crosslinker does not indicate that the crosslinking reaction has not progress at all, nor suggests that the crosslinked resins do not exist, even if the unreacted crosslinker is detected.

Further, an immersion test of polymer into a solvent with a high solubility may be employed for distinguishing whether or not the polymer is in crosslinked condition. That is, the non-crosslinked polymer cannot remain in the solute since such polymer dissolves into the solvent, an analysis may be properly carried out for examining the existence of the polymer in the solute. When the polymer is not detected in the solute, the polymer is recognized to be in a non-crosslinked condition, and the polymer may be distinguished from the crosslinked polymer. In this specification, "gel fraction" is employed.

The above-noted "gel fraction" means the percentage of the gel yielded in a condition that the resin solute comes to lose the independent mobility in the solvent due to the interaction for flocking into a solidified gel. Preferably, the gel fraction of the resin is 30% or more, more preferably 50% or more, still more preferably 70% or more, and 80% or more is particularly preferred. Lower gel fraction represents lower repeating durability; therefore in order to enhance the gel fraction, a curable resin, which is curable by means of heating, exposure to UV irradiation or electron beam and the like, may be incorporated into the resin, alternatively the resin itself may be crosslinked by such means.

The gel fraction may be determined as follows: a piece of coating is peeled from the support to weigh the initial mass. Then the coating is nipped between wire nets of #400 and immersed into a solvent, in which the pre-crosslinking resin being soluble, for 24 hours. The coating is dried under vacuum, then the mass after the drying is measured.

The gel fraction may be calculated by the following equation.

$$\text{Gel Fraction (\%)} = (\text{mass after drying (g)})/\text{initial mass (g)} \times 100 \qquad \text{Equation (1)}$$

In the calculation of the gel fraction by the equation, the mass of the organic substances, having a lower molecular weight, but of the resin ingredients in the thermosensitive layer is to be eliminated. When the mass of the organic substances having a lower molecular weight is not definite, the gel fraction may be obtained by an observation of the resin cross-section by means of transmittance electron microscope (TEM) or scanning electron microscope (SEM) and by measuring the area ratio of the resin and organic substances having a lower molecular weight; and from the area ratio and the respective specific gravity, the mass of the organic substances having a lower molecular weight may be obtained.

Further, when the thermosensitive layer is provided on the support on which the other layers such as a protective layer are laminated, or when another layer is provided between the support and the thermosensitive layer, the gel fraction may be similarly determined such that the layer thicknesses of the thermosensitive layer and the other layer are measured through the observation using TEM or SEM, the depth corresponding to the thicknesses of the other layers are shaved off, thereby the thermosensitive layer is exposed and peeled off, then the above-noted way may be applied similarly.

Further, when a protective layer formed of UV curable resin etc. exists on the thermosensitive layer, the thickness equivalent to the protective layer as well as small depth of thermosensitive layer should be shaved so as to reduce the inclusion of the protective layer as little as possible and to prevent the influence on the obtainable gel fraction.

The above-noted fillers contain inorganic fillers and organic fillers summarily.

Examples of the inorganic filler include calcium carbonate, magnesium carbonate, anhydrous silicic acid, alumina, iron oxide, calcium oxide, magnesium oxide, chromium oxide, manganese oxide, silica, talc, and mica.

Examples of the organic filler include silicone resins, cellulose resins, epoxy resins, nylon resins, phenol resins, polyurethane resins, urea resins, melamine resins, polyester resins, polycarbonate resins; polystyrene resins such as polystyrene, styrene-isoprene copolymer and styrene-vinylbenzene copolymer; acryl resins such as polyvinylidenechloride acryl, polyacrylurethane and polyethyleneacryl; polyethylene resins; formaldehyde resins such as benzoguanamineformaldehyde and melamineformaldehyde; polymethylmethacrylate resins and vinyl chloride resins.

These may be used alone or in combination. When a plurality of fillers are utilized, there is not particular limitation on the combination of inorganic and organic filler. The shape of the filler may be sphere, granular, platelet or needle and the like. The content of filler is ordinarily 5 to 50% by volume.

The lubricant may be properly selected from the conventional materials depending on the application without particular limitations; examples of the lubricant include synthetic wax such as ester wax, paraffin wax and polyethylene wax; vegetable wax such as hardened castor oil; animal wax such as hardened beef tallow; higher alcohol such as stearyl alcohol and behenyl alcohol; higher fatty acid such as margaric acid, lauric acid, myristic acid, palmitic acid, stearic acid and behenolic acid; higher fatty acid ester such as fatty acid ester of sorbitan; amide such as stearic acid amide, oleic acid amide, lauric acid amide, ethylenebisstearicamide, methylenebisstearicamide, methylolstearicacidamide.

The content of lubricants in the thermosensitive layer is preferably 0.1 to 95% by volume, more preferably 1 to 75% by volume.

The above-noted surfactant may be properly selected depending on the application without particular limitations; examples of the surfactant include anionic surfactant, cationic surfactant, nonionic surfactant, and amphoteric surfactant.

The process for forming the above-noted thermosensitive layer may be properly selected depending on the application without particular limitations, for example, such processes may be properly exemplified: (1) process in which the binder resin, the electron-donating coloring compound and electron-accepting compound are dissolved or dispersed in a solvent to prepare a raw fluid of thermosensitive layer, the raw fluid is coated on the support, the solvent is evaporated to form a sheet-like layer and the sheet-like layer is crosslinked at the same time or thereafter; (2) process in which only the binder resin is dissolved in a solvent, then the electron-donating coloring compound and electron-accepting compound are dispersed in the solvent to prepare a raw fluid of thermosensitive layer, the raw fluid is coated on the support, the solvent is evaporated to form a sheet-like layer and the sheet-like layer is crosslinked at the same time or thereafter; and (3) process in which the binder resin, the electron-donating coloring compound and electron-accepting compound are heated and melted and blended without a solvent to form a mixture, the melted mixture is formed into a sheet-like layer and the sheet-like layer is crosslinked after cooling.

In these processes, the sheet-like reversible recording media may be alternatively produced with out the support.

The solvents utilized in the processes (1) and (2) are not determined definitely since they are defined depending on the type of the electron-donating coloring compound and electron-accepting compound; in general, tetrahydrofuran, methylethylketone, methylisobutylketone, chloroform, carbontetrachloride, ethanol, toluene, benzene and the like are exemplified.

Further, the electron-accepting compound exists in a condition of dispersed particulates in the thermosensitive layer.

In order to impart suitable properties as coating material to the coating liquid for the thermosensitive layer, the liquid to be coated for the thermosensitive layer may contain various additives such as pigment, deformer, dispersant, lubricant, preservative, crosslinker and plasticizer.

The coating process may be suitably selected from the conventional processes depending on the application without particular limitations; for example, a support is rewounded from the roll or cut into sheets, then the coating liquid is applied, along with carrying the support, by way of blade, wire-bar, spray, air-knife, bead, curtain, gravure, kiss, reverse roll, dip or die coating process.

The condition for drying the coated liquid for the thermosensitive layer may be suitably selected depending on the application without particular limitations; for example, the drying is carried out approximately at the temperature from ambient to 140° C. for 10 minutes to 1 hour.

The hardening of the resin in the thermosensitive layer may be carried out by means of heating, UV irradiation, electron beam irradiation and the like.

The UV irradiation may be carried out by means of a conventional UV irradiation apparatus. The UV irradiation apparatus may be that comprising a UV source, light kit, power supply, cooling device and carrying instrument.

The UV source may be mercury lump, metal halide lump, gallium lump, mercury xenon lump, flash lump and the like. The wavelength of the UV source may be selected depending on the UV-absorbing wavelength of the photopolymerization initiator or photopolymerization enhancer.

The condition of UV irradiation may be properly selected depending on the application without particular limitations. For example, lump power, carrying rate and the like may be defined depending on the exposed energy necessary for crosslinking the resin.

The electron beam irradiation may be carried out by means of conventional electron beam irradiation apparatuses. Such electron beam irradiation apparatuses may be summarily divided into scanning bean type and area beam type, and the type may be selected considering the irradiation area, irradiation dose and the like. The condition of irradiation may be calculated from the following equation (2), depending on the dose required for crosslinking the resin and considering the electron current, irradiation width, carrying rate and the like.

$$D=(\Delta E/\Delta R)\cdot\eta\cdot I/(W\cdot V) \qquad \text{Equation (2)}$$

wherein "D" represents the required dose (Mrad); "ΔE/ΔR" represents averaged energy loss; "η" represents efficiency; "I" represents electron current (mA); "W" represents irradiation width; and "V" represents carrying rate.

Commercially, the following equation (3) is recommended, which is simplified from equation (2).

$$D\cdot V=K\cdot I/W \qquad \text{Equation (3)}$$

The rating of the instrument is expressed by "Mrad-m/min", the rating of the electron current is selected from about 20 to 500 mA.

The film thickness of the thermosensitive layer may be properly selected depending on the application; preferably the thickness is 1 to 20 μm, more preferably 3 to 15 μm.

When the thickness is excessively low, the image contrast may come to low due to the lower coloring density, on the other hand, when excessively high, the intended coloring density may not be obtained since the temperature distribution comes to broad in the film thereby non-coloring parts appear due to the lower temperature.

<Protective Layer>

The protective layer according to the present invention comprises, in the first aspect, a reactive heterocyclic compound, and inorganic fine particles of which the surface is at least partially treated into hydrophobic, and other ingredients depending on the application.

The protective layer according to the present invention comprises, in the second aspect, inorganic fine particles of which the number-average particle size is 100 μm or less and of which the surface is at least partially treated into hydrophobic, and other ingredients depending on the application.

The reactive heterocyclic compound may be properly selected depending on the application, and (1) reactive heterocyclic monomer and (2) reactive heterocyclic oligomer may be exemplified.

The (1) reactive heterocyclic monomers include, for example, lower molecular-weight compounds comprising at least one vinyl group and at least one heterocycle, and may be properly selected from the compounds that may cause crosslinking reaction through the application of UV ray or electron beam radiation. Examples of the reactive monomer comprising a heterocycle include glycidylacrylate, glycidylmethacrylate, diacrylate with 1,6-hexanediol and diglycidylether, epoxymethacrylate, tetrahydrofurfurylacrylate, caprolactam-modified tetrahydrofurfurylacrylate, neopentylglycol-modifiedtrimethylolpropanediacrylate, pentamethylpiperidylmethacrylate, diacrylated isocyanurate, tris(acryloxyethyl)isocyanurate, caprolactam-modified tris(acryloxyethyl)isocyanurate, tris(methacryloxyethyl)isocyanurate, N-acryloylmorpholine, and N-vinylpyrrolidone. These compounds may be used alone or in combination.

The (2) reactive heterocyclic oligomer may be obtained by reaction of (A) a compound with a skeleton-like heterocycle having a reactive group other than vinyl group, and (B) a lower molecular-weight compound comprising a functional group, which is reactive with the above-noted reactive group of (A), as well as a vinyl group. The reactive oligomer has a molecular weight of a few thousands to a few decade thousands. The reactive groups of (A) and (B) may be selected from combinations such as carboxyl group as well as hydroxyl or amino group; isocyanate group as well as hydroxyl or amino group.

The compounds of (A) may be of lower molecular weight. Preferably, the molecular weight of the compounds (A) is previously increased to a degree by reacting the reactive group of the heterocycle with a compound having a plurality of functional groups such as diol, diamine, dicarboxylic acid, or amino acid, thereby resulting the extension of the reactive groups.

As the compounds (B), pentaerythritoltriacrylate and dipentaerythritolpentaacrylate are exemplified.

The examples of the (2) reactive oligomer comprising a heterocyclic ring include the reaction product of isocyanurate (trimer of hexamethylenediisocyanate (HDI)) and pentaerythritoltriacrylate (PETA); reaction product of isocyanurate of HDI and 2-hydroxyethyl methacrylate (2-HEMA); reaction product of isocyanurate of hydrogenated xylylenediisocyanate (H6XDI) and PETA; reaction product of isocyanurate of H6XDI and 2-HEMA; reaction product of isocyanurate of toluenediisocyanate (TDI) and PETA; reaction product of isocyanurate of TDI and 2-HEMA; reaction product of isocyanurate of isophoronediisocyanate (IPDI) and PETA; and reaction product of isocyanurate of IPDI and 2-HEMA.

As for the above-noted isocyanurate of HDI, D-170N (by Mitsuitakeda-Chem. Co.) may be exemplified. As for the isocyanurate of H6XDI, D-127N (by Mitsuitakeda-Chem. Co.) may be exemplified. As for the isocyanurate of TDI, D-215 (by Mitsuitakeda-Chem. Co.) may be exemplified. As for the isocyanurate of IPDI, Z-4370 (by Bayer Co.) may be exemplified.

In addition, as the (2) reactive oligomer comprising a heterocyclic ring, the reaction product of a lower polymerization polymer comprising a heterocyclic ring as the compound (A)

and the compound (B) may be exemplified. The reactive oligomer has a molecular weight of a few thousands to a few decade thousands.

As for the lower polymerization polymer as the compound (A), polyethyleneglycol, polycarbonatediol, and polyesterdiol may be exemplified.

In addition, as the (2) reactive oligomer comprising a heterocyclic ring, the reaction product of three compounds, i.e. polyesterdiol and isocyanurate (HDI) and 2-hydroxyethyl methacrylate (2-HEMA), and polycarbonatediol and HDI and 2-HEMA, may be exemplified.

The irradiation of UV rays or electron beam may make the protective layer, containing the reactive heterocyclic oligomer (3), a film of three-dimensional crosslinked structure.

The heterocycle, in the above-noted reactive heterocyclic compound, may be properly selected depending on the application without particular limitations; examples of the heterocycle include the rings of encircled fatty chain with one hetero atom such as of oxirane, oxetane, furan, pyran, aziridine, azetidine, pyrrolidine, piperidine, thiirane, thietane, thiophene and thiopyrane; rings having two or more hetero atoms such as of dioxane, morpholine, oxazolidine, piperazine, triazole, thiomorpholine, thiazolidine, oxazole and thiazole; lactone ring such as of cyclodextrin, isocyanurate and pyrrolidon; and the other rings such as lactam ring, isocyanuru ring and of other skeleton.

The size of the hetero ring is not particularly limited and properly selected depending on the application; for example three to twelve membered rings or (2n+2) membered rings (n=integer) are preferred, more preferably three to ten membered ring. The bonding may be saturated or partially unsaturated.

Further, the condensed ring with hetero atom in part as of xanthene or indole may be allowable.

The protective layer may contain additional reactive compounds, other than the reactive heterocyclic compounds, such as reactive monomer, reactive oligomer and reactive polymer in order to increase the properties of the protective layer.

Examples of the additional reactive monomer include various mono-functional or multi-functional acrylate, methacrylate, vinylester, ethylene derivatives, and allyl compounds.

Examples of the additional reactive oligomer include urethaneacrylate oligomer, epoxyacrylate oligomer, polyesteracrylate oligomer, polyetheracrylate oligomer, vinyloligomer, and unsaturated-polyester oligomer.

Among these compound, multi-functional monomer and multi-functional oligomer having 4 or more functionality are preferred in particular.

The multi-functional monomer may be properly selected depending on the application without particular limitations, examples of the multi-functional monomer include trimethlolpropanetriacrylate, pentaerythritoltriacrylate, glycerin PO added triacrylate, trisacryloyloxyethylphosphate, pentaerythritoltetraacrylate, triacrylate of propyleneoxide added by 3 mol trimethylolpropane, glycerylpropoxytriacrylate, dipentaerythritol-polyacrylate, polyacrylate of dipentaerythritol added caprolactone, propionic acid-dipentaerythritol triacrylate, hydroxypival modified dimethylolpropinetriacrylate, propionic acid-dipentaerythritol tetraacrylate, ditrimethylolpropanetetraacrylate, propionic acid-dipentaerythritol pentaacrylate, trimethylolpropanetriacrylate added urethane prepolymer, dipentaerythritolhexaacrylate(DPHA), and DPHA added ∈-caprolactone.

As for the multi-functional oligomer, the reaction product of the adduct of HDI with trimethylolpropane and 2-hydroxyethyl methacrylate (2-HEMA); reaction product of buret of HDI and 2-HEMA; reaction product of three reactants, i.e. polyesterdiol, adduct of HDI and 2-HEMA; and reaction product of three reactants, i.e. polycarbonatediol, adduct of HDI and 2-HEMA may be exemplified.

Among these compounds, multi-functional monomers are preferred in light of heat-resistance and mechanical strength, in particular dipentaerythritolhexaacrylate, pentaerythritoltetraacrylate, and the mixture of these compounds and urethane acrylate are preferred.

As for the other reactive polymers, the usage of the silicone resin that have silicone site such as siloxane part may be preferable since the surface lubricity and durability increase. Examples of the reactive group include a vinyl group, acryl group and the like.

Preferably, the loadings of the silicone resin having the reactive group are 0.05 to 50% by mass based on the total amount of the resin ingredients in the protective layer, more preferably 0.1 to 30% by mass. When the loadings are less than 0.05% by mass, the effect of the additive silicone resin having the reactive group may not appear practically, on the other hand, when more than 50% by mass, the protective layer may be excessively soft and little resistant.

The content of the reactive heterocyclic compound is preferably 10 to 90% by mass, more preferably 15 to 80% by mass, still more preferably 30 to 70% by mass. When the content is less than 10% by mass, the property of the reactive heterocyclic compound may be inferior, on the other hand, when more than 90% by mass, the intended properties owing to the combined reactive compound, other than the reactive heterocyclic compounds, may not be easily imparted.

The protective layer comprises inorganic fine particles of which surface is at least partially treated into hydrophobic. The inorganic fine particles may be properly selected depending on the application without particular limitations; the examples include amorphous silica, alumina, zirconia, titanium dioxide, zinc oxide, talc, clay, mica, kaolin and the like. Among these, amorphous silica is particularly preferable.

The number-average particle size of the inorganic fine particles is preferably 0.8 μm or less, more preferably 100 nm or less, in the above-noted first aspect. Further, the shape is preferably spherical.

The number-average particle size of the inorganic fine particles is 100 nm or less, more preferably 5 to 50 nm, in the above-noted second aspect. Further, the shape is preferably spherical.

The usage of the microscopic inorganic fine particles (filler) having 100 nm or less of number-average particle size may provide the suitable viscosity of the coating liquid for the protective layer, the flow-down may be prevented following to the coating, thereby uniform films tend to be produced more easily. Further, the defects of coating may be synergistically reduced. The reason is not necessarily clear, but is believed that the fine particles hardly coagulate in the fluid for protective layer therefore exist homogeneously in the fluid.

The process for producing the inorganic fine particles having 100 nm or less of number-average particle size may be a conventional process such as a gas-phase reaction or liquid-phase reaction process.

As for the process for determining the number-average particle size, such a process is recommendable as taking image of the particles in the first place by means of SEM or TEM, performing image analysis by a computer or handmade histogram, thereafter calculating the number-average particle size; since the other processes based on laser diffraction and Coulter Counter measure the size of coagulations.

The surface of the inorganic fine particles is, at least partially preferably entirely, treated into hydrophobic by applying at least one compound selected from the group consisting of silane coupling agents, titanate coupling agents, and aluminum-containing coupling agent.

The silane coupling agent may be properly selected from conventional agents depending on the application without particular limitations; examples of the agent include silane monomers, silicone compounds and silane coupling agent such as dichlorosilane, methyltrichlorosilane, trimethylalkoxysilane, dimethyldialkoxysilane, methyltrialkoxysilane, hexamethyldisilazane, and various silicone oil; vinylsilane compounds such as vinyltriethoxysilane, vinyltrichlorosilane, vinyltrimethoxysilane, vinyltris(β-methoxyethoxy)silane, γ-methacryloxypropyltrimethoxysilane, γ-methacryloxypropylmethyldimethoxysilane, epoxysilane compounds such as β-(3,4-epoxycyclohexyl)ethyltrimethoxysilane, γ-glycidoxypropyltrimethoxysilane, γ-glycidoxypropylmethyldiethoxysilane; aminosilane compounds such as γ-aminopropyltriethoxysilane, γ-aminopropyltrimethoxysilane, N-β-(aminoethyl)-γ-aminopropyltrimethoxysilane, N-β-(aminoethyl)-γ-aminopropylmethyldimethoxysilane, and γ-phenylaminopropyltrimethoxysilane, reactive silane compounds such as γ-mercaptopropyltrimethoxysilane, γ-isocyanatepropyltriethoxysilane, γ-methacryloxypropyltrimethoxysilane, γ-methacryloxypropyltriethoxysilane, γ-methacryloxypropylmethyldimethoxysilane, and ureidopropyltriethoxysilane. These may be used alone or in combination.

Among these compounds, organic silane compounds having reactive unsaturated groups such as vinylsilane compounds, epoxysilane compounds, aminosilane and reactive silane compounds are preferred with respect to higher density and toughness of the resulting layers, in particular reactive silane compounds are most preferable.

Examples of the titanate coupling agent include isopropyltriisostearoyltitanate, isopropyltris(dioctylpyrophosphate) titanate, isopropyltri(N-aminoethyl)titanate, tetraoctylbis (ditridesulphosphate)titanate, tetra(2,2-diallyloxymethyl-1-buthyl)bis(ditridesul)phosphatetitanate, bis (dioctylpyrophosphate)oxyacetatetitanate, bis (dioctylpyrophosphate)ethylenetitanate.

Example of the aluminum-containing coupling agent includes acetoalkoxyaluminumdiisopropylate.

The surface treatment of the inorganic fine particles by means of surface modifying agents may be carried out in a process that a solution of coupling agent, prepared by dissolving the coupling agent in a suitable solvent at optimal concentration, is sprayed against the stirring inorganic fine particles. Commercial solutions of coupling agents may also be employed. The treating process may also be that the coupling agent is added directly to the dispersion of the inorganic fine particles, alternatively the inorganic fine particles and coupling agent are stirred with heating in a powder mixer.

To the protective layer, another inorganic filler or organic filler may be added in order to enhance surface roughness and/or printing ability.

The inorganic filler may be properly selected depending on the application without particular limitations, examples of the filler include carbonate such as calcium carbonate and magnesium carbonate; phosphate such as calcium phosphate; silicate such as anhydrous silicate, hydrous silicate, hydrous aluminum silicate, and hydrous calcium silicate; oxides such as alumina, zinc oxide, iron oxide, and calcium oxide; and hydroxide such as aluminum hydroxide.

The material that constitute the organic filler may be properly selected depending on the applications without particular limitations; examples of the material include silicone resins, cellulose resins, epoxy resins, nylon resins, phenol resins, polyurethane resins, urea resins, melamine resins, polyester resins, polycarbonate resins, polystyrene resins, polystyreneisoprene, polystyrenevinylbenzene, polyvinylidenechloride, acrylurethane resins, ethyleneacryl resins, polyethylene resins, benzoguanazineformaldehyde resins, melamine formaldehyde resins, polymethylmethacrylate resins, and polyvinylchloride.

The protective layer is hardened by crosslinking by means of heating, UV rays, electron beam, or combination thereof. By the way, in the heating and crosslinking means in which somewhat high temperature as well as prolonged period are required, the sufficient high temperature may not be allowed due to the undesired coloring of thermosensitive layers, as a result, the coating strength may be insufficient as the protective layer. Further, the crosslinking curing by means of electron beam may produce a sufficient coating strength within a shot period; however, the apparatus for electron beam irradiation and the resin for electron beam curing are relatively expensive, and also the running cost are relatively expensive since the replacement with inert gas is additionally necessary. Therefore, UV curing is often preferred.

When the curing is carried out through UV rays, photopolymerization initiator and/or promoter are added to the protective layer.

The photopolymerization initiators are generally divided into radical reaction and ion reaction types. In addition, the radical reaction type may be divided into photocleavage type and hydrogen-drawing type.

The photopolymerization initiator may be properly selected depending on the application without particular limitations; examples of the initiator include isobutylbenzoinether, isopropylbenzoinether, benzomethyletherbenzoinmethylether, 1-phenyl-1,2-propanedione-2-(o-ethoxycarbonyl)oxime, 2,2-di methoxy-2-phenylacetophenonebenzyl, hydroxycyclohexylphenylketone, diethoxyacetophenone, 2-hydroxy-2-methyl-1-phenylpropane-1-one, benzophenone, chlorothioxanthone, 2-chlorothioxanthone, isopropylthioxanthone, 2-methylthioxanthone, chloro-substituted benzophenone. These may be used alone or in combination.

The photopolymerization promoters are such agents that may increase curing rate along with the photopolymerization initiator of hydrogen-drawing type such as of benzophenone and thioxanthone; for example aromatic tertiary amines and fatty amines are available. Specifically, as the photopolymerization promoters, p-dimethylaminobenzoicacid isoamylester and p-dimethylaminobenzoicacid ethylester are exemplified. These may be used alone or in combination.

The loadings of the photo polymerization initiator or photopolymerization promoter are preferably 0.1 to 20% by mass based on the total resin amount in the protective layer, more preferably 1 to 10% by mass.

Further, an UV rays absorber of organic material may be included in the protective layer; the content is preferably 0.5 to 10% by mass based on the total resin in the protective layer.

In addition, conventional surfactant, antioxidant, leveling agent, photostabilizer, antistatic agent and the like may be incorporated as the additives.

The coating process may be suitably selected from the conventional processes depending on the application without particular limitations; for example, the substrate is rewounded from the roll or cut into sheets, then the coating is applied, along with carrying the support, by way of blade, wire-bar, spray, air-knife, bead, curtain, gravure, kiss, reverse roll, dip or die coating process.

The coated sheets are conveyed into a ventilating dryer successively, then dried at 30 to 150° C. for 10 seconds to 10 minutes.

In order to carrying out the coating process with zero defects, the fluid for coating the protective layers may be subjected to filtration by means of stainless mesh, nylon mesh, cotton filter, or carbon fiber filter, and ultrasonic vibration for 1 minutes to 200 hours, more preferably 10 minutes to 80 hours so as to remove contaminations and bubbles and break down the flocked dispersion.

Among these, the filtration by means of cotton filter or membrane filter and ultrasonic deagglomeration are particularly preferred. Preferably, the entire process is carried out in a clean room of class 10000 or less.

The drying of the coating is preferably carried out by blowing air or inert gas such as nitrogen, of being passed through a filter, dehumidifier and heater, onto one surface or both surfaces of the coating. Preferably, the pinhole-like defects on the printing are suppressed to $100/m^2$ or less through high coating uniformity owing to suitable selections on the coating conditions.

When the protective layer is to be thermosetted, a curing operation is provided if necessary after drying the coating. The crosslinking is enhanced in the case of thermocrosslinking by the curing operation, and also the quality comes to be stable owing to the decrease of the solvent remainder.

The curing operation may be carried out for shorter period at higher temperature or for longer period at lower temperature in a thermostat. Preferably, the curing operation is carried out at 10 to 130° C. for 1 minute to 200 hours, more preferably 15 to 100° C. for 2 minutes to 180 hours.

Further, as for the curing condition, the period for substantially perfect crosslinking is not appropriate with respect to productivity. From this standpoint, preferably the curing condition is 40 to 100° C. for 2 minutes to 120 hours.

The heating may be the direct blowing on the coated surface, alternatively may be heated statically in a thermostat in a rolled configuration or stacked sheets. When higher temperature is not appropriate, the drying under reduced pressure is recommendable.

The temperature may be increased or decreased step by step, also the heating period may be divided into a plurality of times so as to attain a controlled properties or efficient productivity.

The film formation by means of UV rays may be carried out through a photopolymerization reaction by means of UV irradiation apparatus after drying the coating. The UV curing may be carried out by means of conventional UV irradiation apparatus without particular limitations. The UV radiation source may be a mercury lump, metal halide lump, potassium lump, mercury xenon lump, flash lump and the like. Also the UV radiation source may be selected so as to provide emission spectrum corresponding to the photopolymerization initiator and photopolymerization promoter.

The lump output and carrying velocity may be controlled depending on the irradiation energy required for crosslinking the resin.

In the case of curing by means of electron beam, the electron beam irradiation apparatus may be selected from scanning or non-scanning type considering the irradiated area and irradiated dose. The specific irradiation conditions may be decided as to the electric current, irradiation width and carrying rate considering the required dose for crosslinking the resin.

The thickness of the protective layer is preferably 0.1 to 20 μm, more preferably 0.5 to 10 μm, still more preferably 1.5 to 6 μm. When the layer thickness is less than 0.1 μm, sufficient durability may not be achieved such that the protective layer is destroyed following to the repeated printing and erasing images, or easily attacked by chemicals, and consequently deprived of the performance as recording media. When the layer thickness is more than 20 μm, the images tend to be fuzzy with less repeatability of dots (fine accuracy of images); and also the energy required for printing and erasing tend to increase due to less thermal conductivity, consequently the load on the apparatus tend to be enlarged.

<Intermediate Layer>

Preferably, an intermediate layer is provided between the thermosensitive layer and the protective layer according to the present invention, in order to improve the adhesive quality between the thermosensitive layer and the protective layer, to prevent the deterioration of the thermosensitive layer due to the coating of the protective layer, and to prevent the additive agent migration into the protective layer; thereby the preservability of the coloring images may be improved.

Further, an incorporation of the curable resin into the intermediate layer may enhance the heat resistance of the reversible thermosensitive recording medium still more; thereby the more improved repeatable durability may be achieved.

The intermediate layer is mainly composed of resin; the resin for the intermediate layer may be the resin of the thermosensitive layer.

Preferably, an UV ray absorber is incorporated into the intermediate layer. Examples of the UV ray absorber in organic type include benzotriazoles, benzophenones, salicylates, cyanoacrylates and cinnamic acids. Among these, benzotriazoles are preferred, in particular the benzotriazoles are preferred of which hydroxyl groups are protected by adjacent bulky functional groups. Specifically, 2-(2'-hydroxy-3',5'-di-t-butylphenyl)benzotriazol, 2-(2'-hydroxy-3'-t-butyl-5'-methylphenyl)benzotriazol, 2-(2'-hydroxy-3',5'-di-t-butylphenyl)-5-chlorobenzotriazol and 2-(2'-hydroxy-3'-t-butyl-5'-methylphenyl)benzotriazol are preferably exemplified.

Further, such copolymer as acryl resins and styrene resins are acceptable that have a pendant skeleton which exhibits UV ray absorption performance. The content of the UV ray absorber is preferably 0.5 to 80% by mass based on the total resin mass in the intermediate layer.

In the intermediate layer, inorganic compounds that exhibit UV ray absorbing or shielding property (sometimes referred as "UV ray controlling inorganic compound") may be incorporated.

As for the UV ray controlling inorganic compound, metal compounds are exemplified of which average particle size is 100 nm or less. Examples of the metal compound include such metal oxides or metal complex oxides as zinc oxide, indium oxide, alumina, silica, zirconium oxide, tin oxide, cerium oxide, iron oxide, antimony oxide, barium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate and potassium titanate, such metal sulfides or sulfates as zinc sulfide and barium sulfate, such metal carbides as titanium carbide, silicon carbide, molybdenum carbide, tungsten carbide and tantalum carbide, and such metal nitride as aluminum nitride, silicone nitride, boron nitride, zirconium nitride, vanadium nitride, niobium nitride, gallium nitride.

The super fine particles of metal oxides are preferred, in particular silica, alumina, zinc oxide, titanium oxide, and cerium oxide are preferred. In addition, the super fine particles of metal oxides may be utilized of which the surface is treated with silicone, wax, organic silane or silica.

The content of the UV ray controlling inorganic compounds is preferably 1 to 95% by volume. These organic or inorganic UV ray absorber may be incorporated into the thermosensitive layer.

The solvent of the coating liquid for the intermediate layer, the dispersing apparatus, coating process of the intermediate layer, and the drying and curing processes of the intermediate layer may be conventional and substantially the same with those of the thermosensitive layer and protective layer.

The thickness of the intermediate layer may be properly selected depending on the application without particular limitations; preferably is 0.1 to 20 μm, more preferably is 0.5 to 5 μm.

In order to utilize effectively the applied heat in the present invention, an insulating undercoat layer may be provided between the support and the thermosensitive layer. Further, the undercoat layer may be provided for the purpose of improving the adhesion between the support and the thermosensitive layer and preventing the penetration of thermosensitive material into the support.

The undercoat layer may be formed by coating a binder resin in which organic or inorganic fine hollow particles are incorporated. The resin for the undercoat layer may be substantially the same with that of the thermosensitive and protective layers.

Further, the undercoat layer may contain at least one of filler selected from inorganic fillers such as calcium carbonate, magnesium carbonate, titanium oxide, silicon oxide, aluminum hydroxide, kaolin and talc, and various organic fillers, and also lubricant, surfactant and dispersant.

The coefficient of kinetic friction of the recording medium is preferably 0.3 or less so as not to cause image deterioration due to mechanical damages even after the repeated printing and erasing. When the coefficient of kinetic friction is more than 0.3, the inadequate conveyance may be induced due to the poor slip properties of the medium surface.

In order to make the coefficient of kinetic friction 0.3 or less, preferably silicone with reactive group, polymer grafted with silicone, wax, mold release such as zinc stearate, or lubricant such as silicone oil is added into the protective layer.

The loadings of the lubricant are preferably 0.01 to 50% by mass, more preferably 0.1 to 40% by mass based on the total mass of the resin ingredients in the protective layer. The lubricant may affect the coefficient at a small amount. When the loadings are more than 50% by mass, the adhesion may be poor with the underlying layer.

The coefficient of kinetic friction may be determined by means of HEIDON type testing machine with a ceramic ball in a condition that the loading is 200 g and transfer rate is 0.75 mm/sec, for example.

The surface roughness of the reversible thermosensitive recording medium is preferably 0.2 μm or less. When the surface roughness is more than 0.2 μm, the gloss may be insufficient, gloss alternation may be induced along with the repeated usage, the erasing traces may come to be recognizable, and an illusion is induced such that erasing remainders have increased.

The surface roughness is determined according to JIS B0601, specifically the surface is observed and measured by means of Digital Microscope VK-8510 (by Keyence Co.).

The reversible thermosensitive recording medium may be formed into various shapes depending on the application such as card-like, sheet-like or roll-like shape.

The applications of the recording medium formed into a card-like shape include prepaid card, point card and also credit card. The recording medium formed into a sheet-like shape of normal document size such as A4 size may be applied broadly into temporary output applications such as normal document, instructing letter for process management, circulation document, and conference data, needless to say trial printings, owing to the wider printable area than the card-like size when an printing-erasing apparatus is introduced.

The recording medium formed into a roll-like shape may be applied for display board, notice plate and electronic white board by being integrated into an instrument with a printing-erasing part. Such display instruments may be appropriately utilized in a clean room since dusts and contaminants are not emitted.

The recording medium may also comprise irreversible thermosensitive layer. In this case, the coloring color of the respective thermosensitive layers may be the same or different. Further, on the surface of the thermosensitive layer or on the opposite surface, a printing such as offset printing and gravure printing or coloring layer with any patterns may be provided partially or entirely by means of an inkjet printer, heat transfer printer, or sublimation type printer. Further, on the entire or part of the coloring layer, an OP varnish layer based on curable resin may be provided. The above-noted any patterns include letter, design, figure, photography and infrared-detectable information. Further, any of the respective layers may be colored by simply adding dyes or pigments.

In addition, the recording medium may be provided a hologram for security. For enhancing the design of the recording medium, design such as a personal image, company mark or symbol mark may be provided by applying concaves and convexes of relief or interior (dug or carved patterns).

The formation and erasion of images on the reversible thermosensitive recording medium may be carried out by means of conventional image processing apparatus, preferably by means of the image processing apparatus as explained later.

The image processing apparatus is preferably of the type that comprises an image forming unit for forming images on the recording media and an image erasing unit for erasing images from the recording media, more preferably of the type that comprises a combined unit for forming and erasing image that provides shorter processing period. Specifically, an image processing apparatus is exemplified of the type that is equipped with a thermal head and is able to process the images by altering the energy applied to the thermal head; alternatively of the type that the image forming unit comprises a thermal head, and the image erasing unit comprises a contacting pressing means such as a thermal head, ceramic heater (e.g. a heater in which a heating resistive element is screen-stenciled on a alumina substrate), hot stamp, heat-roller, heat block and the like, or a non-contacting pressing means that utilizes warm blow, infrared ray and the like.

(Reversible Thermosensitive Recording Media)

According to the reversible thermosensitive recording medium, the reversibly displayable thermosensitive layer and the information-memorizing part are provided in an identical card (integrated), and a part of the memorized information of the information-memorizing part is displayed on the thermosensitive layer, thereby the owner of the card may convenient in that the information can be confirmed by only viewing the card without a particular device. Further, in the case that the content of the information-memorizing part is overwritten, the recording medium may be repeatably utilized by overwriting the display of the thermosensitive recording part.

The member comprising the information-memorizing part and the reversible displaying part may be classified in the following two types.

(1) A part of the member comprising the information-memorizing part is utilized as a support of the reversible thermosetting recording medium, and the thermosensitive layer is disposed on the support directly.

(2) A thermosensitive layer is disposed separately on a support to form a reversible thermosensitive recording medium, and the support is adhered to the member comprising the information-memorizing part.

In these cases of (1) and (2), the position of the disposed information-memorizing part may be the opposite side of the thermosensitive layer on the support of the recording medium, between the support and the thermosensitive layer, or on a part of the thermosensitive layer, provided that the information-memorizing part and the reversible displaying part are designed to perform their properties.

The information-memorizing part may be formed of a magnetic thermosensitive layer, magnetic stripe, IC memory, optical memory, hologram, RF-ID tag card and the like. In the sheet medium of which the size is over the card size, an IC memory, RF-ID tag are preferably employed. By the way, the RF-ID tag is composed of an IC chip and an antenna connected to the IC chip.

The magnetic thermosensitive layer may be formed by coating on a support a coating material comprising conventional iron oxide, barium ferrite etc. and vinylchloride resins, urethane resins, nylon resins etc., or by vapor deposition, spattering etc. without using resins. The magnetic thermosensitive layer may be provided on the face of the support opposite to the thermosensitive layer, between the support and the thermosensitive layer, or on a part of the thermosensitive layer. Further, the reversible thermosensitive material for displaying may be employed for the memorizing part in a form of barcode, two dimensional code and the like. The magnetic recording and IC is more preferable among these.

As for the hologram, the rewritable type is preferred, for example, the rewritable hologram in which coherent light is written on a liquid crystal film of azobenzene polymer is exemplified.

The member comprising the information recording part typically includes a card, disc, disc cartridge, and tape cassette. Specifically, examples of the member include a thicker card such as IC card and optical card; disc cartridge containing an information-rewritable disc such as optical magnetic disc (MD) and DVD-RAM; disc in which disc cartridge is not utilized, e.g. CD-RW; overwrite type disc such as CR-R; optical information recording medium with phase-changing recording material (CD-RW); and videotape cassette.

Further, the member comprising the information-memorizing part and the reversible displaying part may exhibit remarkably increased availability. That is, in case of card for example, the owner of the card can confirm the information only by viewing the card without a particular device through displaying on the thermosensitive layer a part of the information memorized in the information recording part.

The information-memorizing part may be properly selected depending on the application without particular limitations, provided that the necessary information may be recorded, for example, a magnetic recording, contact type IC, non-contact type IC, and optical memory are exemplified.

The magnetic thermosensitive layer may be formed by coating on a support a coating material comprising conventional iron oxide, barium ferrite etc. and vinylchloride resins, urethane resins, nylon resins etc., otherwise by vapor deposition, spattering etc. without using resins. Further, the reversible thermosensitive material for displaying may be employed for the memorizing part in a form of barcode, two dimensional code and the like.

More specifically, the recording medium may be appropriately employed for the reversible thermosensitive recording medium, reversible thermosensitive recording member, image processing apparatus, and image processing method. In the present invention, "surface of the reversible thermosensitive recording medium" means the surface of the thermosensitive side such as the surface of printing layer or OP layer, not only of the protective layer but all of or part of the surface which contact with the thermal head during the printing and erasing.

Figure 2:
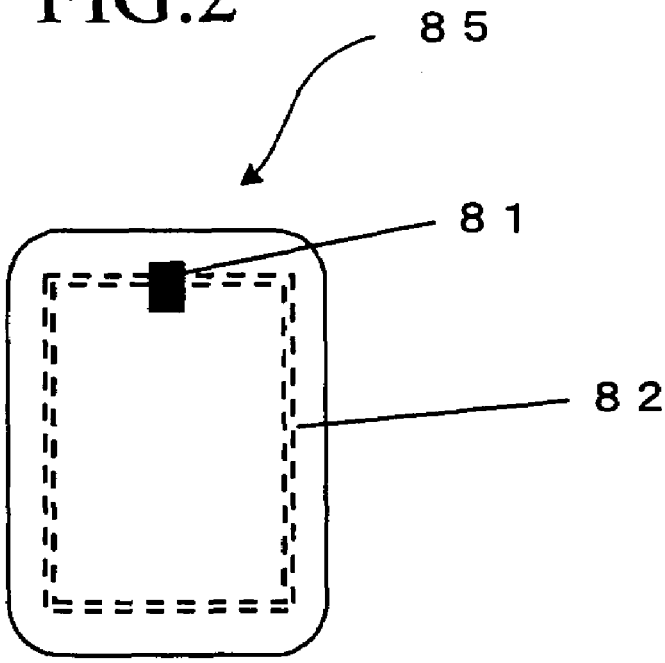
FIG. 2 schematically shows an example of RF-ID tag.

The reversible thermosensitive recording member comprises reversibly displayable thermosensitive layer and information recording part, and an RF-ID tag is exemplified as the preferable information recording part. FIG. 2 schematically shows RF-ID tag 85. The RF-ID tag 85 is composed of IC chip 81, and antenna 82 connected to the IC chip. The IC chip 81 is divided into four parts of memorizing part, power supply controlling part, transmitting part and receiving part; the respective part are imposed individual roll, and communications are carried out. The communications are achieved through exchanging data using electric waves by means of the antennas of RF-ID tag and the reader-writer.

Specifically, the antenna of RF-ID receives electric waves to cause an electromotive force through an induction due to resonance effect. As a result, the IC chip in the RF-ID tag is activated, the information in the chip is turned into signals, followed by the dispatch of the signals from the RF-ID tag. The information is received by the antenna of the reader-writer to recognize it by the data processing apparatus, and then data processing is achieved at the soft side.

The RF-ID tag is formed into label-like or card-like shape. As shown FIG. 3, RF-ID tag 85 may be laminated to the reversible thermosensitive recording medium 90. RF-ID tag 85 may be laminated on the surface of thermosensitive layer or back layer, preferably on the surface of back layer. For the purpose of laminating the RF-ID tag and the recording medium, conventional adhesive agents and tacky agents may be utilized.

Figure 3:
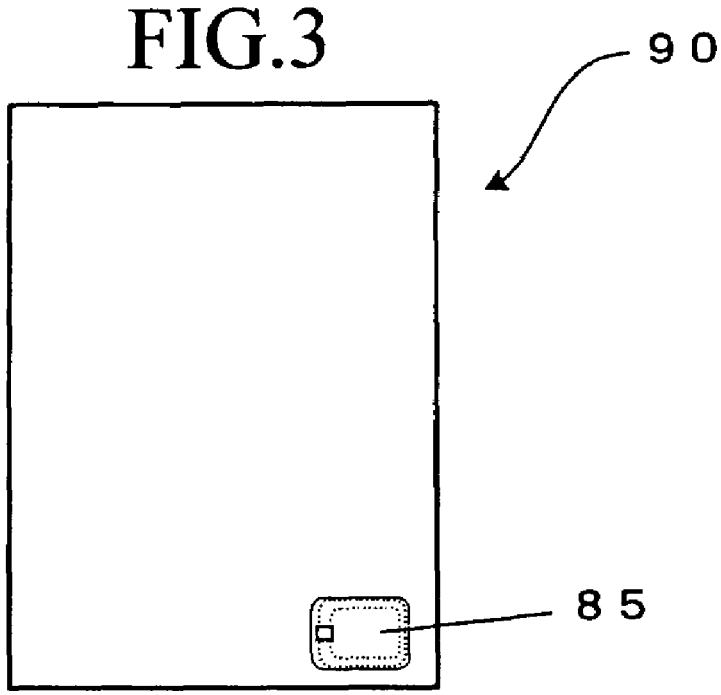
FIG. 3 schematically shows a configuration, in which an RF-ID tag is affixed to the back side of an example of the reversible thermosensitive recording medium.
Figure 4A:
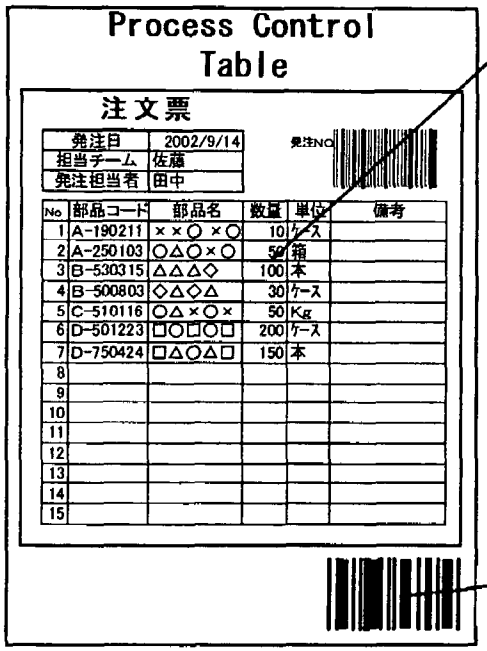
FIGS. 4A and B schematically show an example of a commercial rewritable sheet (reversible thermosensitive recording medium according to the present invention).
Figure 4B:
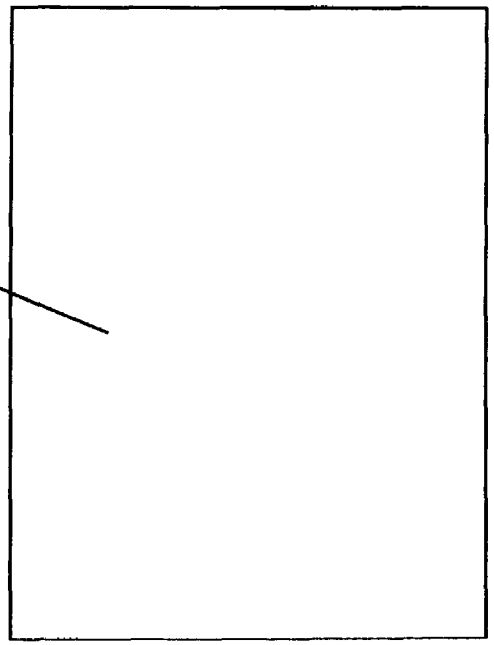

FIGS. 4A and B exemplify the reversible thermosensitive recording media applied into commercial rewritable sheet 90 (reversible thermosensitive recording medium). As shown in FIG. 4A, a rewritable displaying part is provided on the thermosensitive layer side. On the behind side (back layer), the RF-ID tag may not be laminated as shown in FIG. 4B, or the RF-ID tag may be laminated as shown in FIG. 3. The application of RF-ID tag is preferable in light of higher availability.

Figure 5:
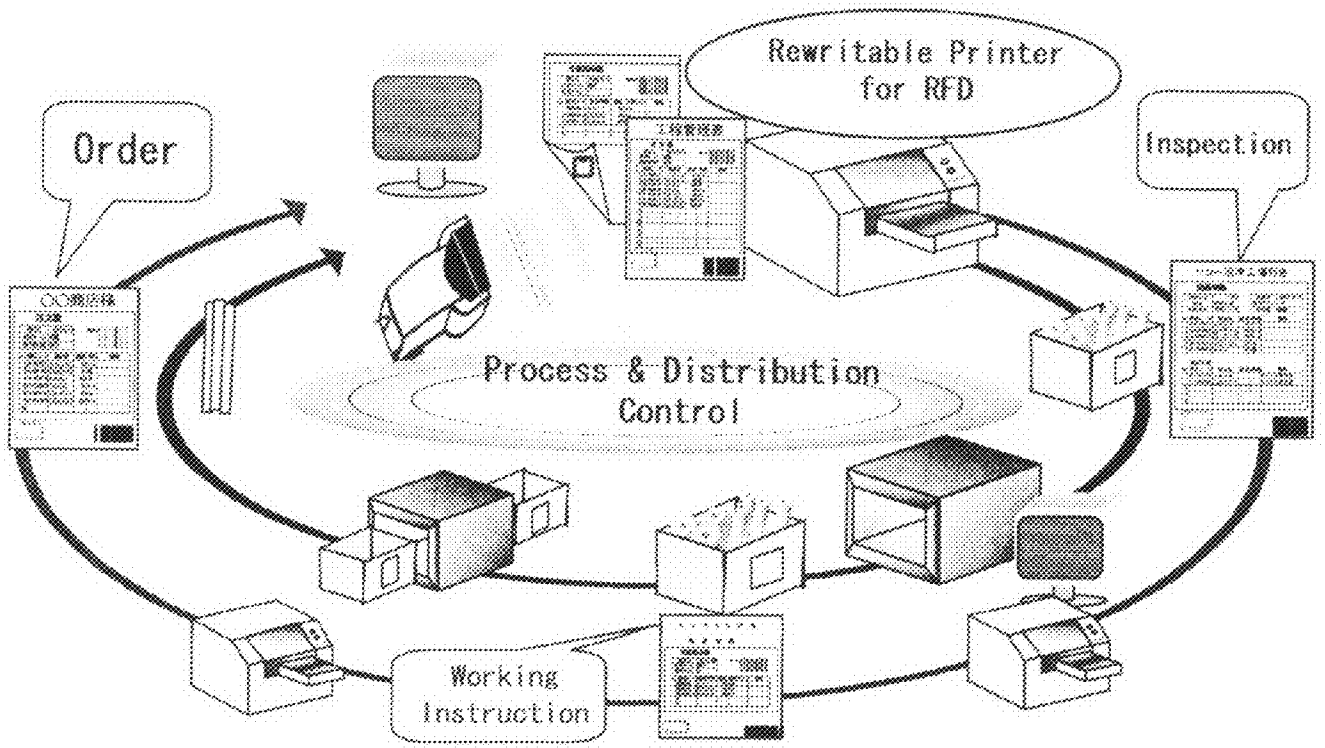
FIG. 5 schematically exemplifies how to use the commercial rewritable sheet (reversible thermosensitive recording medium according to the present invention).

FIG. 5 exemplifies the way in which the commercial rewritable sheet combined with the reversible thermosensitive recording medium (rewritable sheet) and RF-ID tag is utilized. Initially, such information as an article name and amount is recorded on the rewritable sheet or RF-ID tag with respect to the delivered raw materials, and the raw material are inspected with the information of the rewritable sheet or RF-ID tag contained in a circulating box for example. In the next step, a working instruction is granted on the delivered raw material, the rewritable sheet and RF-ID tag with the recorded information turn to the working instruction letter, and progress to the working step. Then, the rewritable sheet and RF-ID tag recorded with the order information is attached to the worked product as the order instruction letter. The rewritable sheet is recovered after the shipment, the shipment information is subjected to reading, then the rewritable sheet is utilized as a delivery letter again.

(Reversible Thermosensitive Recording Label)

The reversible thermosensitive recording label comprises an adhesive layer or tacky layer on the opposite side of the image forming side of the reversible thermosensitive recording medium (in the case that the thermosensitive layer exists on the support, the opposite side of the support carrying the thermosensitive layer), and the other layers properly selected depending on the necessity. Further, in the case that the support of the recording medium is of heat fusion, the adhesive layer or tacky layer on the opposite side of the image forming side is not necessarily required.

The shape, configuration, size and the like of the adhesive layer or tacky layer may be properly selected depending on the application without particular limitations. The shape may be sheet-like or film-like; the configuration may be of single layer or laminated layers; and the size may be larger or smaller than the thermosensitive layer.

The material of the adhesive layer or tacky layer may be properly selected depending on the application without particular limitations; examples of the material include urea resins, melamine resins, phenolic resins, epoxy resins, polyvinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic ester copolymers, methacrylic ester copolymers, natural rubber, cyanoacrylate resins, silicone resins. These may be used alone or in combination. Further the material may be of hot-melt type, and may be used either with a disposable release paper or without a disposable release paper.

The reversible thermosensitive recording label is normally utilized in a configuration laminated to a substrate sheet such as a card, in which the reversible thermosensitive recording label may be laminated on the entire or part of the substrate sheet, or on one side or both sides.

The shape, configuration, size and the like of the substrate sheet may be properly selected depending on the application without particular limitations. The shape may be platelet and the like; the configuration may be of single layer or laminated layers; and the size may be properly selected depending on the size of the reversible thermosensitive recording medium. For example, the substrate may be a sheet or laminated body formed of chlorine-containing polymers, polyester resins, biodegradable plastic and the like.

The chlorine-containing polymer may be properly selected depending on the application without particular limitations; examples of the polymer include polyvinyl chloride, vinyl chloride-vinyl acetate copolymers, vinylchloride-vinylacetate-vinylalcohol copolymers, vinylchloride-vinylacetate-maleicacid copolymers, vinylchloride-acrylate copolymers, polyvinylidenechloride, vinylidenechloride-vinylchloride copolymers, and vinylidenechloride-acrylonitrile copolymers.

Examples of the polyester resins include polyethylene terephthalate (PET), polybutylene terephthalate (PBT), alternatively condensed esters of acid ingredients such as terephthalic acid, isophthalic acid, and alcohol ingredients such as ethylene glycol, cyclohexanedimethanol (e.g. PETG, trade name by Eastman Chemical Co.).

Examples of the biodegradable plastic include natural polymer resins comprising polylactic acid, starch, denaturated polyvinyl alcohol and the like, and microbiological product resins including β-butyric acid and β-valeric acid.

Further, the substrate may be synthetic resin sheet or paper formed of polyacetate resins, polystyrene (PS) resins, epoxy resins, polyvinylchloride (PVC) resins, polycarbonate (PC) resins, polyamide resins, acryl resins, silicone resins and the like. These materials may be properly combined or laminated.

As for the laminated body, the body comprising a core sheet formed of laminated two sheets of white polyvinyl chloride resin of 250 μm thick, and two laminated over sheet of transparent polyvinyl chloride resin of 100 μm thick on the upper and lower sides of the core sheet may be exemplified. Also the laminate body comprising a core sheet formed of laminated two sheets of white PETG of 250 μm thick, and two laminated over sheet of transparent PETG of 100 μm thick on the upper and lower sides of the core sheet may be exemplified.

Figure 6:
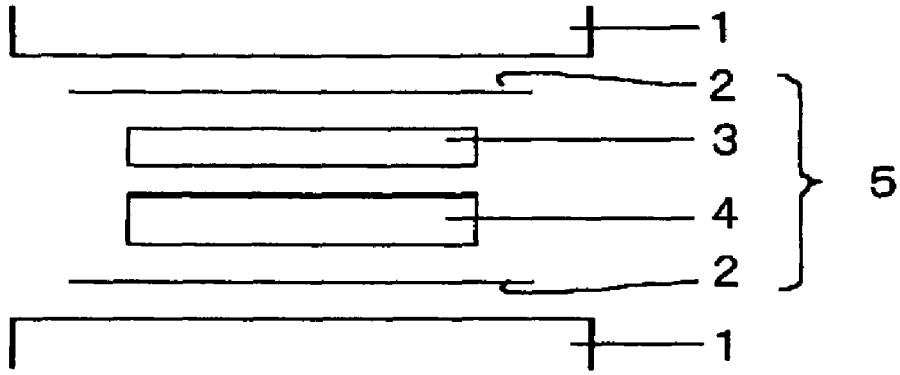
FIG. 6 schematically exemplifies an embodiment, in which a recording medium and substrate sheet are bonded in thermo-compression process.

Concerning the process for laminating the substrate sheet and the reversible thermosensitive recording label, as shown in FIG. 6, the reversible thermosensitive recording label 3 and substrate sheet 4 are superimposed oppositely, and disposed and pressed between two sheets of mirror plate 2, along with being heated through hot plate 1.

Figure 7:
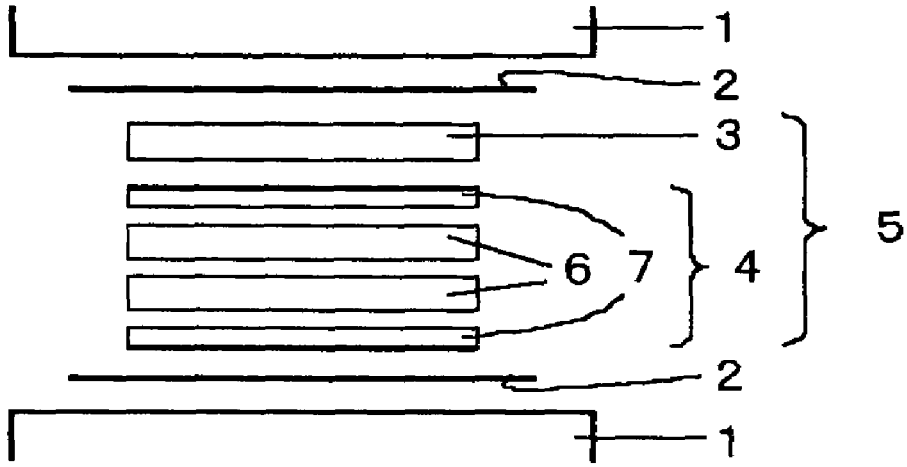
FIG. 7 schematically exemplifies another embodiment, in which a recording medium and substrate sheet are bonded in thermo-compression process.

Further, as shown in FIG. 7, the similar way may be applied toward the substrate sheet 4, which is composed of the superimposed core sheet 6 and over sheet 7.

The adhesion with press and heat may be carried out through a conventional way, normally at the pressure of 5 to 70 kgf/cm$^2$, preferably 10 to 50 kgf/cm$^2$, and at the temperature of 80 to 170° C., preferably 90 to 150° C., by means of a hot-pressing apparatus equipped with heating plate 1 for example.

In the case that the laminate of transparent polyvinyl chloride sheet/white polyvinyl chloride sheet/white polyvinyl chloride sheet/transparent polyvinyl chloride sheet is employed, the heating temperature at the hot pressing is preferably 130 to 150° C. Further, in the case that the laminate of transparent PETG/white PETG/white PETG/transparent PETG is employed, the heating temperature at the hot pressing is preferably 110 to 130° C.

As for another way for laminating the substrate sheet and the reversible thermosensitive recording label, they are adhered with heating previously, then laminated with heating. The adhesion with heating may be achieved by pressing a rubber roll against them followed by laminating with heating.

The optimal condition of the adhesion with heating may be properly selected depending on the substrate sheet in use, normally carried out by keeping at 90 to 130° C. for 1 hour or less, preferably 1 to 50 minutes.

In the case that the reversible thermosensitive recording label comprises a protective layer of which surface is roughened by filler and the like, and the recording label is adhered with heating and pressing on a label-like substrate, such matters appear that the filler at the surface of the protective layer is pressed into the protective layer or underlying layer through the heating and pressing, thereby the surface gross increases and the repetition durability decreases due to the lowering of the filler effect, and also that when printing and erasing are repeated in the condition of the increased surface gloss, the gloss at the printed-erased parts is decrease, as a result that the gloss difference from the non-printed-erased parts comes to be recognized as a non-uniformity. The presence of the protective layer in the reversible thermosensitive recording medium may eliminate such matters. In this aspect, the surface roughness 0.15 μm or less of the recording medium is more preferred since higher gloss may be obtained.

When at least one of adhesive layer and tacky layer exist in the recording medium, the recording medium may be affixed on an entire or part of a thicker substrate such as polyvinylchloride card with magnetic stripe to which the recording medium is usually difficult to be affixed, thereby a part of the information memorized in magnetic may be displayed.

The reversible thermosensitive recording medium may be an alternative to a thicker card such as IC card and optical card, flexible disc, disc cartridge containing rewritable disc such as optical magnetic recording disc (MD) and DVD-RAM, disc without disc cartridge such as CD-RW, write-once disc such as CD-R, optical information recording medium (CD-RW) based on phase-change recording material, and display label on videotape cassette.

Figure 8:
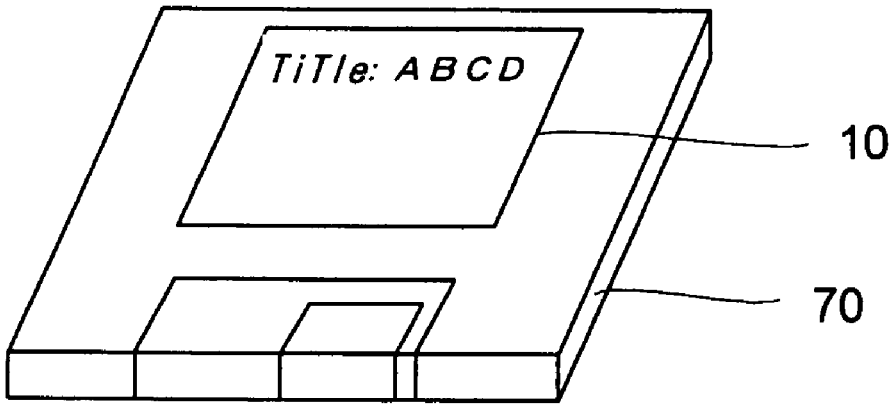
FIG. 8 schematically exemplifies a configuration, in which a recording label is laminated on an MD disc cartridge.

FIG. 8 exemplifies the recording medium 10 affixed to MD disc cartridge 70. In this case, such application is allowable that the displayed content is automatically altered depending the alternation of the memorized content in the MD. Further, in a case of disc without disc cartridge such as CD-RW, the recording label may be directly affixed to the disc.

Figure 9:
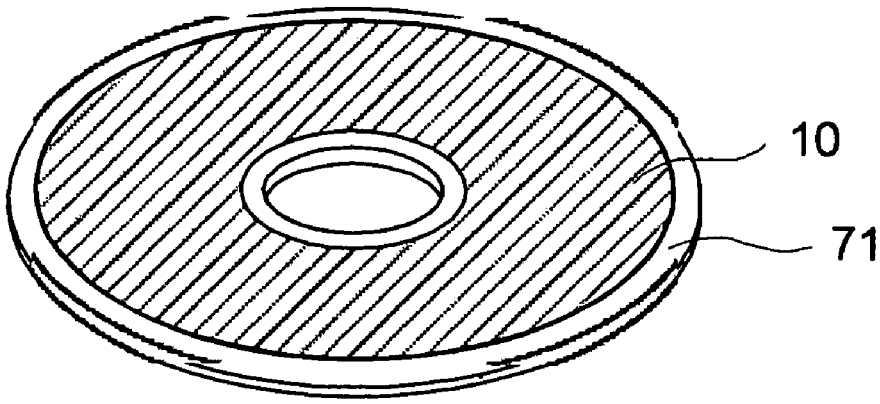
FIG. 9 schematically exemplifies a configuration, in which a recording label is laminated on an optical information recording medium.

FIG. 9 exemplifies the recording medium 10 affixed to CD-RW 71. In this case, the recording label is affixed on a write-once disc such as CD-R in place of CD-RW, then a part of the memorized information in the CD-R may be rewritten and displayed.

Figure 10:
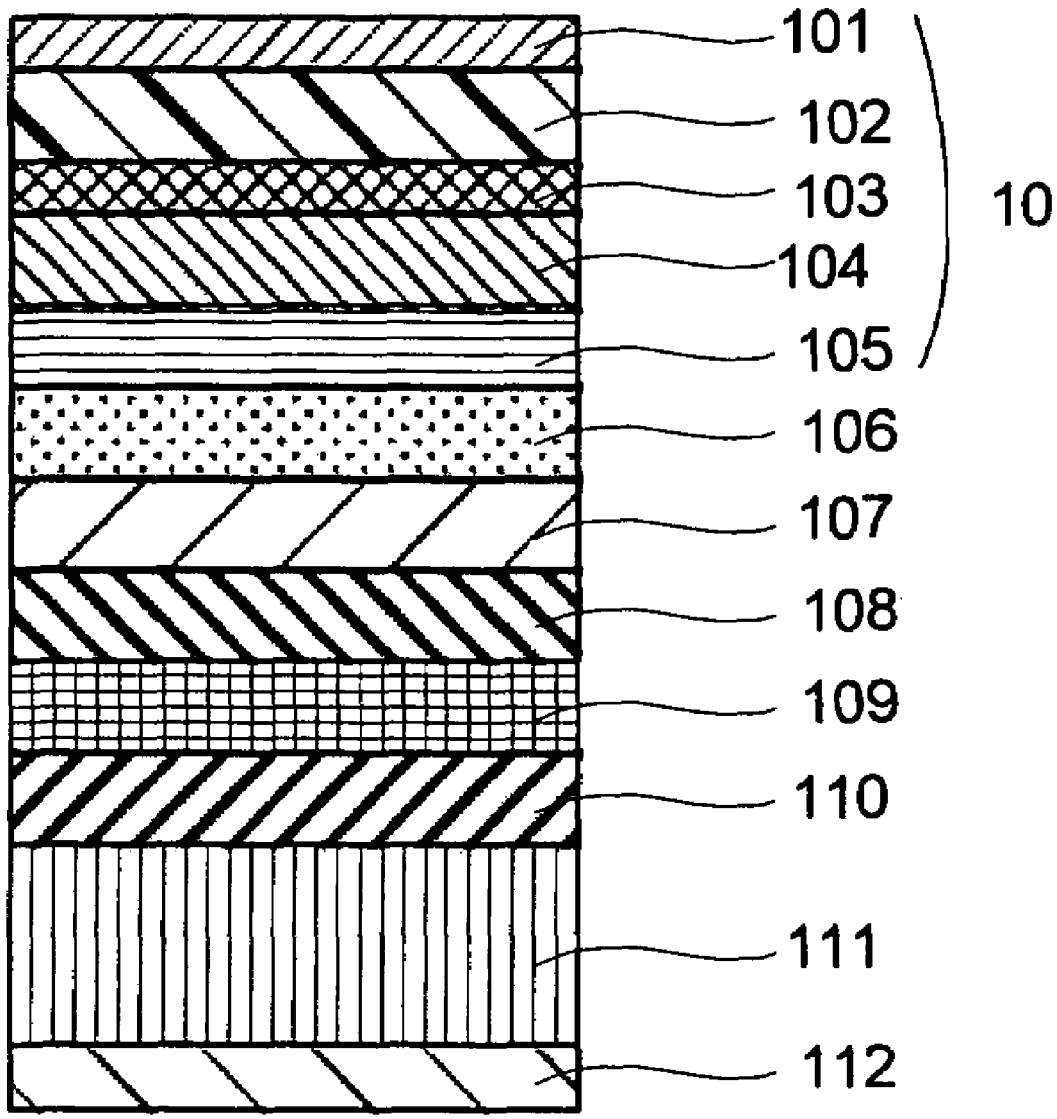
FIG. 10 schematically exemplifies a configuration in a cross-section, in which a recording label is laminated on an optical information recording medium.

FIG. 10 exemplifies the recording medium 10 affixed to an optical information recording medium (CD-RW) with phase-change recording material of AgInSbTe type. As for the fundamental constitution of the CD-RW, the first dielectric layer 110, optical information memorizing layer 109, the second dielectric layer 108, reflecting heat-dissipation layer 107, and intermediate layer 106 is provided in order on the substrate 111 with guide grooves. A hard coat layer 112 is provided on the back side of the substrate 111. On the intermediate layer 106 of the CD-RW, the recording label 10 is affixed. The reversible thermosensitive recording medium 10 is composed of an adhesive layer or tacky layer 105, back layer 104, support 103, thermosensitive layer 102, and protective layer 101 in order.

The dielectric layer is not necessarily required on both sides of the optical information memorizing layer. When the substrate is formed of lower thermal-resistant material such as polycarbonate resin, preferably the first dielectric layer 110 is provided.

Figure 11:
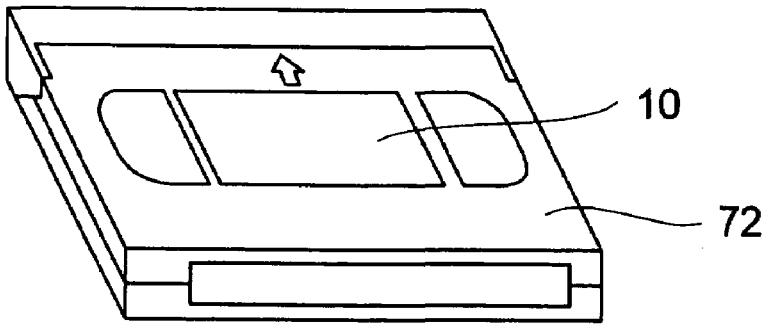
FIG. 11 schematically exemplifies a configuration, in which a recording label is laminated on a videocassette.

FIG. 11 exemplifies the recording medium 10 affixed to a videocassette 72. In this case, such application is allowable that the display is automatically altered depending on the change of the memories in the videocassette.

As for the way to provide the performance of the reversible thermosensitive recording on a card, disc, disc cartridge, and tape cassette, other than the way of affixing the recording label on the card etc., the way of coating the thermosensitive layer directly on them, and the way of pre-forming the thermosensitive layer on another support followed by transferring the thermosensitive layer on them may be exemplified. In the way of transferring the thermosensitive layer, the adhesive or tacky layer of hot-melt type may be provided on the thermosensitive layer.

In the case that on a stiff card etc. the recording label is affixed or thermosensitive layer is provided, preferably an elastic and cushioning layer or sheet is disposed between the stiff substrate and the recording label or thermosensitive layer so as to increase the contacting ability with the thermal head and to form uniform images.

Figure 12:
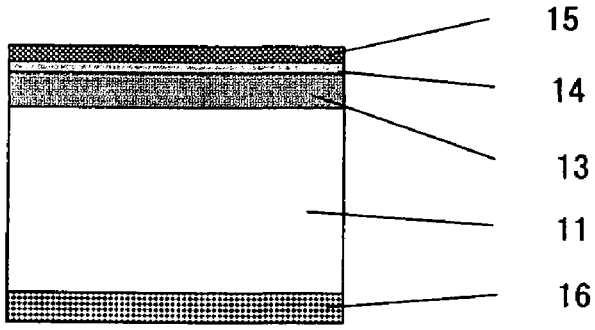
FIG. 12 exemplifies a layer construction of recording label in a schematic cross-section.
Figure 13:
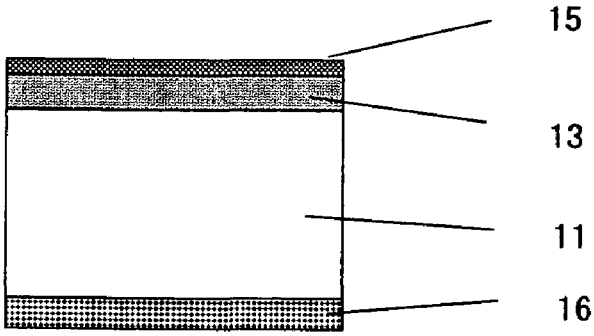
FIG. 13 exemplifies another layer construction of recording label in a schematic cross-section.

In an aspect, the recording medium may be a film, as shown in FIG. 12, comprising reversible thermosensitive layer 13, intermediate layer 14, and protective layer 15 on support 11, and back layer 16 on the back side of support 11. In another aspect, the recording medium may be a film, as shown in FIG. 12, comprising reversible thermosensitive layer 13 and protective layer 15 on support 11, and back layer 16 on the back side of support 11.

Figure 14B:
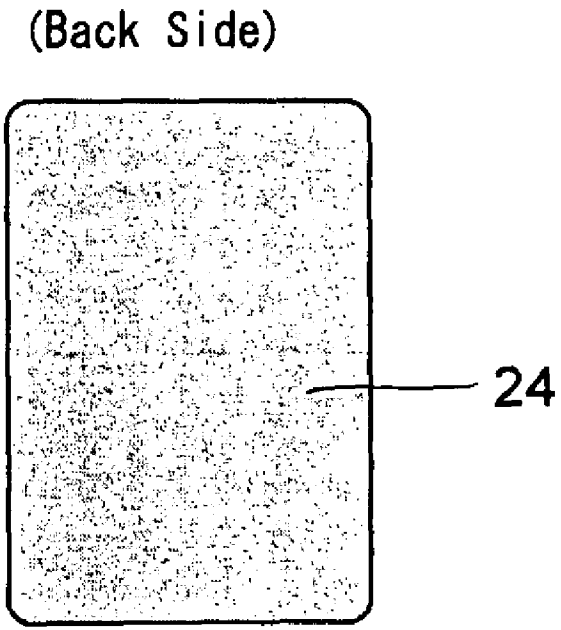
FIG. 14B schematically shows the back side of FIG. 14A.
Figure 14A:
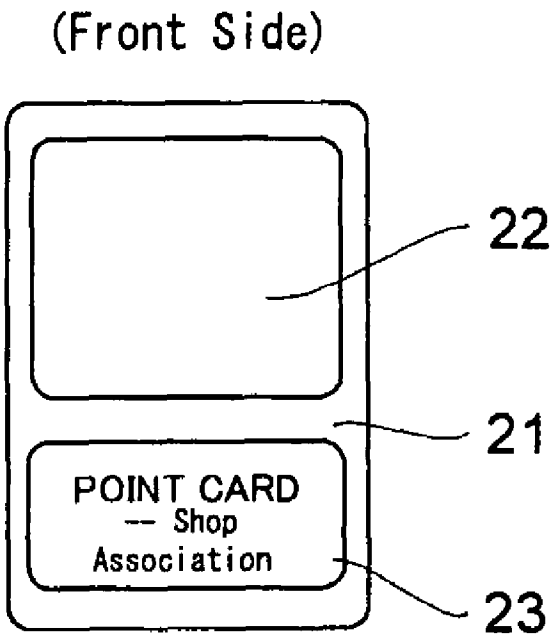
FIG. 14A schematically exemplifies a front side of a recording medium, in which the recording medium is formed into a card shape.

The films (reversible thermosensitive recording medium) of various aspects may be properly applied to the various commercial rewritable sheet of sheet-like shape provided with RF-ID tag 85 as shown in FIG. 5 for example. In addition, the films may be formed and utilized in a configuration of reversible thermosensitive recording card 21 with a printed display part 23 as shown in FIG. 14A for example, wherein on the back side of the card, there are provided a magnetic recording part and a back layer 24 on the magnetic recording part.

Figure 15B:
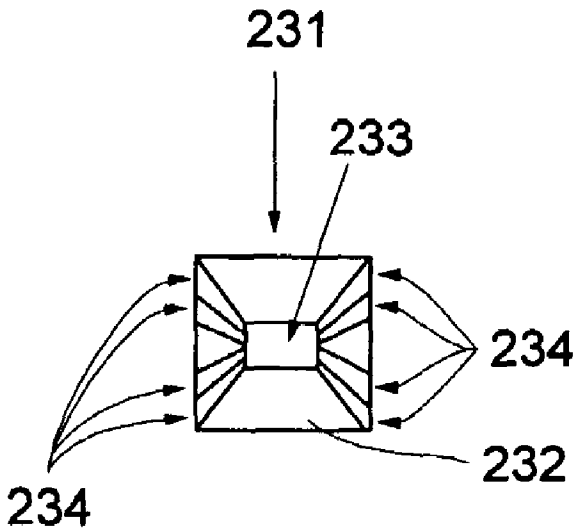
FIG. 15B schematically shows an IC chip to be embedded into the depression part for embedding the IC chip.
Figure 15A:
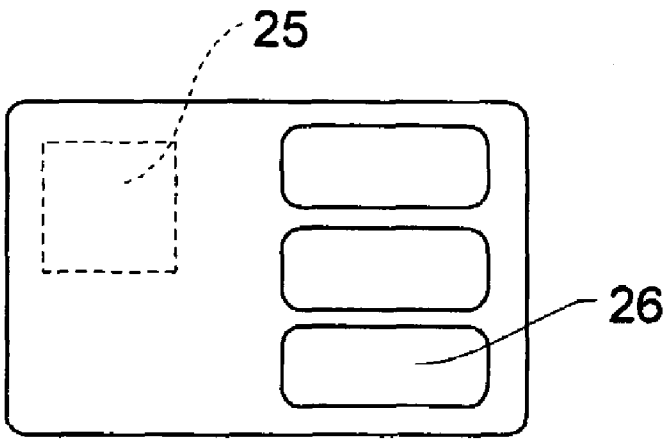
FIG. 15A schematically exemplifies another recording medium, in which the recording medium is formed into another card shape.

The reversible thermosensitive recording member (card) shown in FIG. 15A is obtained by working a film, comprising a thermosensitive layer and protective layer on a support, into a card shape, forming a depression part for enveloping an IC chip. In the aspect shown in FIG. 15A, a rewritable recording part 26 is processed in label configuration on the card-like recording medium, and on the back side of the card a depression part 25 for enveloping an IC chip is formed.

A wafer 231 is incorporated and fixed into the depression part 25 as shown in FIG. 15B. In the wafer 231, an integrated circuit 233 is provided on a wafer substrate 232, and a plurality of contacting terminals 234 electrically connected to the integrated circuit 233 are provided on the wafer substrate 232. The contacting terminals 234 are exposed to the back side of the wafer substrate 232 in a configuration that an exclusive printer (reader-writer) may read and write the specific information through the electric contact with the contacting terminals 234.

The performance of the reversible thermosensitive recording layer will be explained with reference to FIGS. 16A and B. FIG. 16A is a schematic constitutional block diagram showing the integrated circuit 233. In addition, FIG. 16B a constitutional block diagram showing an example of memorized data of PAM. The integrated circuit 233 is comprised of LSI, in which CPU 235 that may perform controlling actions in a pre-determined step, ROM 236 that may store the operation program data of CPU 235, and RAM 237 that may write and read the necessary data are included.

In addition, the integrated circuit 233 comprises I/O interface 238 that receives input signals and send the input data to CPU 235 and receives the output signals from CPU 235 and dispatch outside, and also (not shown) power on reset circuit, clock generating circuit, pulse divided perimeter circuit (interruption pulse generating circuit), and address decode circuit CPU 235 may perform the action of interruption control routine depending on the interruption pulse provided periodically by the pulse divided perimeter circuit. Further, the address decode circuit may decode the address data from CPU 235 and send signals to ROM 236, RAM 237, and I/O interface 238. A plurality of contacting terminals 234 (eight in FIG. 16A) are connected to the I/O interface 238, the specific data from the exclusive printer (reader-writer) are inputted to CPU 235 from the contacting terminals 234 through the I/O interface 238. CPU 235 responds the input signals and performs various actions according to the program data stored in ROM 236, as well as outputs pre-determined data and signals to the sheet reader-writer through I/O interface 238.

Figure 16B:
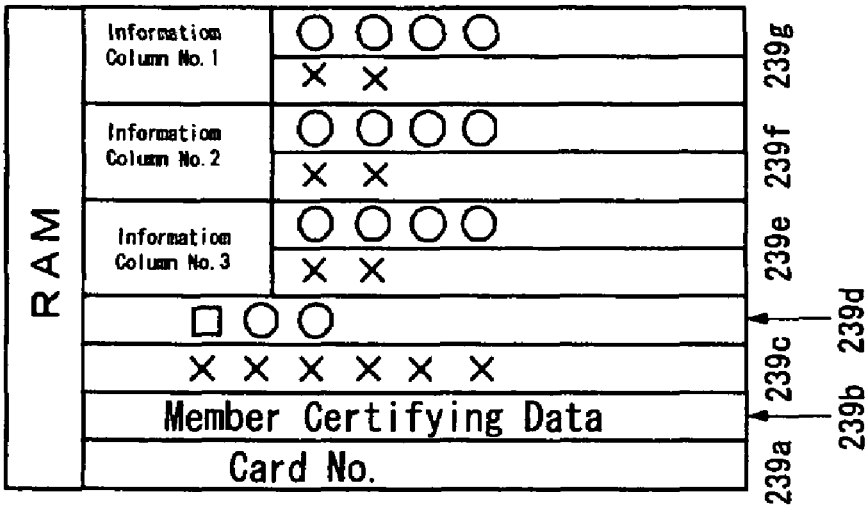
FIG. 16B schematically shows that the RAM comprises a plurality of memory regions.
Figure 16A:
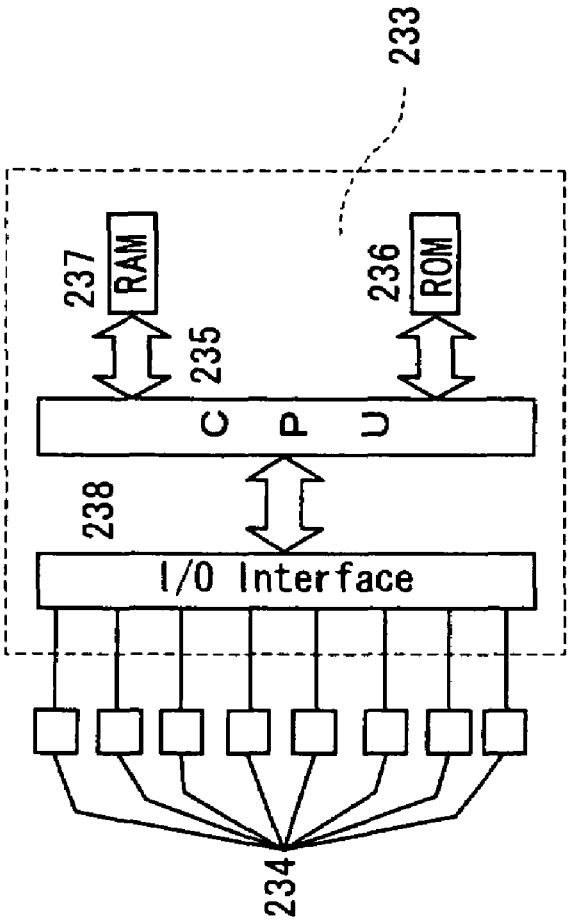
FIG. 16A schematically shows an example of constituent block diagram of an integrated circuit.

As shown FIG. 16B, RAM 237 comprises a plurality of memorizing regions 239*a* to 239*g*. For example, a sheet number is memorized in region 239*a*. For example, in memorizing region 239*b*, ID data of sheet owner such as full name, belonging, telephone number are memorized. For example, memorizing region 239*c* is provided as the remaining blank for the user, or the information concerning handling is memorized. For example, the information concerning the prior manger and prior user is memorized in the memorizing regions 239*d*, 239*e*, 239*f* and 239*g*.

The thermosensitive recording label or the recording member may be subjected to image processing by various image processing methods and image processing apparatuses, and the images may be preferably formed and erased by the image processing apparatus as explained later.

(Image Processing Method and Image Processing Apparatus)

The image processing apparatus comprises at least one of an image forming unit and image erasing unit, and the other unit properly selected depending on the necessity such as conveying unit, controlling unit and the like.

The image processing method performs forming or erasing images by heating the thermosensitive recording medium, and comprises the other operations properly selected depending on the necessity such as conveying, controlling and the like.

The image forming method may be properly carried out by means of the image forming apparatus, the image forming or erasing through the heating of the thermosensitive recording medium may be carried out by the image forming or image erasing unit, and the other operations may be carried out by means of the other unit.

—Image Forming Unit and Image Erasing Unit—

The image forming unit is the unit in which images are formed through heating the reversible thermosensitive recording medium. The image erasing unit is the unit in which images are erased through heating the reversible thermosensitive recording medium.

The image forming unit may be properly selected depending on the application, from a thermal head, laser and the like. These may be used alone or in combination.

The image erasing unit may be properly selected depending on the application, from a hot stamp, ceramic heater, heat roller, heat block, hot blow, thermal head, laser irradiation apparatus and the like. Among these, the ceramic heater is preferred. By means of the ceramic heater, the apparatus may be miniaturized, the erasing condition may be stabilized, and images with high contrast may be obtained. The operating temperature of the ceramic heater may be properly selected depending on the application, preferably 110° C. or more, more preferably 112° C. or more, most preferably 115° C. or more, for example.

By means of the thermal head, the apparatus may be miniaturized still, in addition, the electric power consumption may be saved, and the power supply may be replaced to a handy type. Further, the performance of image forming and erasing may be combined into one thermal head, thereby the apparatus may be miniaturized still more. In the case that the recording and erasing are achieved with one thermal head, once the prior images are erased entirely, then new images may be recorded; alternatively an overwrite type may be provided in which the individual image is erased at variable energy level and new images are recorded. In the overwrite type, the total period for recording and erasing is relatively short, resulting in the speed-up of the recording.

In the case that the reversible thermosensitive recording member (card) with the thermosensitive layer and information memorizing part is utilized, the reading unit and rewriting unit for the memories in the information memorizing part are included in the above-noted apparatus.

The conveying unit may be properly selected depending on the application, provided that the unit performs conveying the recording media successively; a conveying belt, conveying roller, and combination of conveying belt and conveying roller may be exemplified.

The controlling unit may be properly selected depending on the application, provided that the unit performs controlling the respective steps, from a sequencer, computer and the like.

Figure 17:
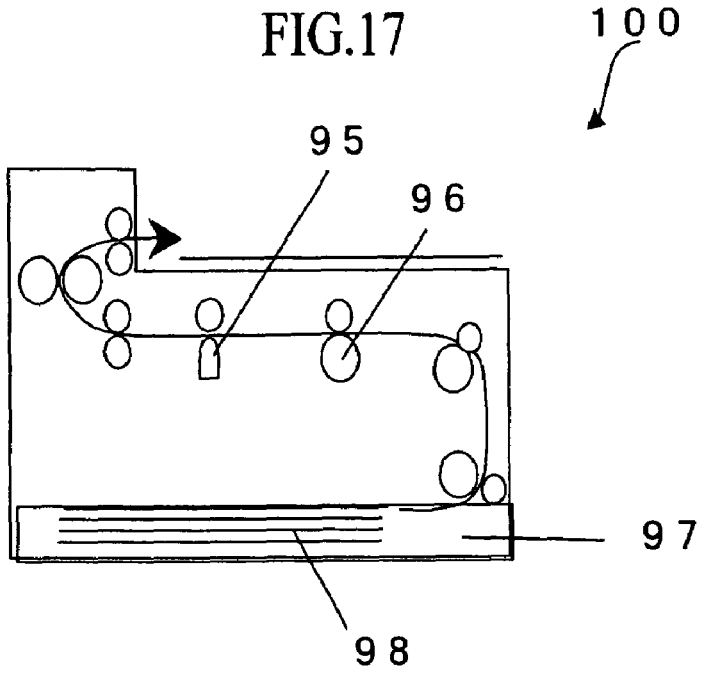
FIG. 17 schematically exemplifies an image processing apparatus utilized for an image processing method.

One aspect of the image processing method through the image processing apparatus will be explained with reference to FIGS. 17 to 19. As shown in FIG. 17, the image processing apparatus 100 comprises heat-roller 96, thermal head 95, and conveying roller. In the image processing apparatus, the images recorded on the thermosensitive layer are heated and erased by means of heat-roller 96. Then the processed new information is recorded by means of thermal head 95 on the thermosensitive layer.

Figure 18:
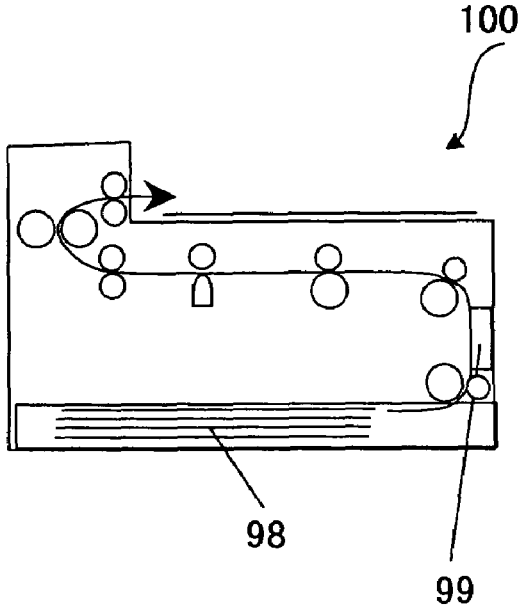
FIG. 18 schematically exemplifies another image processing apparatus utilized for an image processing method.
Figure 19:
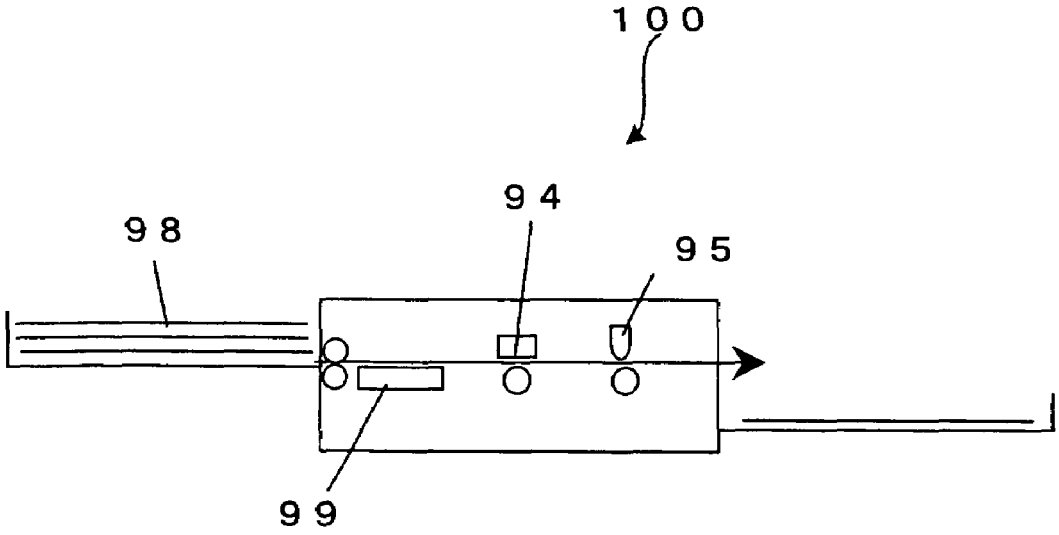
FIG. 19 schematically exemplifies still another image processing apparatus utilized for an image processing method.

In the case that the recording medium comprises the RF-ID tag, the apparatus comprises an RF-ID reading device 99 also as shown in FIGS. 18 to 19. In this case, the parallel type of image processing apparatus may be allowable as shown in FIG. 19.

As shown in FIGS. 18 to 19, in the image processing apparatus 100, the information in the RF-ID tag affixed on the recording medium is read by means of RF-ID reader-writer 99 initially, new information is inputted in the RF-ID, then the images recorded in the thermosensitive layer are heated and erased by means of the heat-roller 96. Then based on the information that has been read and rewritten by the RF-ID reader-writer, the processed new information is recorded on the thermosensitive layer by means of the thermal head.

By the way, the RF-ID reader-writer may be replaced to a bar-code reading device and magnetic head. In the case of the bar-code reading device, the bar-code information recorded in the thermosensitive layer is read, then the bar-code and visual information recorded in the thermosensitive layer is erased by means of the heat-roller, and then the new information processed based on the information from the bar-code is recorded in the thermosensitive layer as bar-code and visual information by means of the thermal head.

In the image processing apparatus shown in FIGS. 17 to 18, there exists a tray for stacking the recording media, from which the recording media may be picked up sheet by sheet through a paper-feeding way of friction pad type. The conveyed recording media is transferred through the conveying roller to the RF-ID reader-writer area, then the reading and writing are achieved. Further, the recording medium is conveyed through the conveying roller to the heat-roller area of the erasing unit, where the visual information recorded in the medium is erased. Then, the recording medium is conveyed to the thermal head area, where new information is recorded in the recording medium. Thereafter, the recording medium is conveyed through the conveying roller, and discharged from the upper exit portion.

By the way, the temperature of the heat-roll is controlled so as to match with the erasing temperature of the recording medium. For example, the surface temperature of the heat-roller is preferably 100° C. to 190° C., more preferably 110° C. to 180° C., most preferably 115° C. to 170° C.

In the following, explanations will be continued with reference to FIGS. 20A and B. The image processing apparatus shown in FIG. 20A comprises thermal head 53 as the heating unit, ceramic heater 38, magnetic head 34, conveying rollers 31, 40 and 47.

Figure 20A:
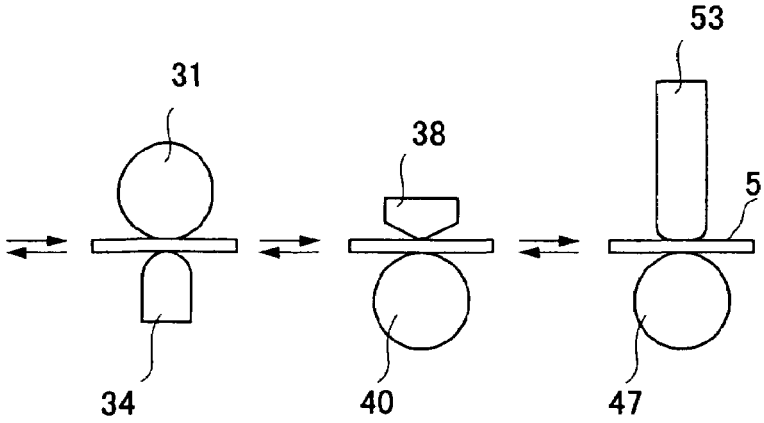
FIG. 20A schematically exemplifies an image processing apparatus, wherein the image erasing is carried out by a ceramic heater, and the image forming is carried out by a thermal head respectively.

As shown in FIG. 20A, the information memorized in the magnetic thermosensitive layer of the recording medium is read by means of the magnetic head initially. Then, heating by means of the ceramic heater erases the images recorded in the thermosensitive layer. Further, the new information processed based on the information read by the magnetic head is recorded in the thermosensitive layer. Thereafter, the information in the magnetic thermosensitive layer is replaced to the new information.

In the image processing apparatus shown in FIG. 20A, the reversible thermosensitive layer 5, the magnetic thermosensitive layer being provided on the opposite side of the thermosensitive layer, is conveyed along the conveying root (shown by back-forth arrows) or conveyed in the reverse direction along the conveying root. The recording medium 5 is subjected to magnetic recording or erasing in the magnetic thermosensitive layer between the magnetic head 34 and the conveying roller 31, and subjected to a heat treatment for erasing images between the ceramic heater 38 and the conveying roller 40, and then images are formed between the thermal head 53 and conveying roller 47, thereafter discharged out of the apparatus. As explained earlier, the ceramic heater 38 is preferably set at 110° C. or more, more preferably 112° C. or more, most preferably 115° C. or more.

By the way, the rewriting of the magnetic recording may be before or after the image erasing by means of the ceramic heater. In addition, the recording medium is conveyed reversibly after passing between the ceramic heater 38 and conveying roller 40, after passing between the thermal head 53 and conveying roller 47, or after passing between the thermal head 53 and conveying roller 47, if necessary. The duplicated heat treatment by means of ceramic heater 38, and the duplicated printing by means of thermal head 53 may be applied in some instances.

Figure 20B:
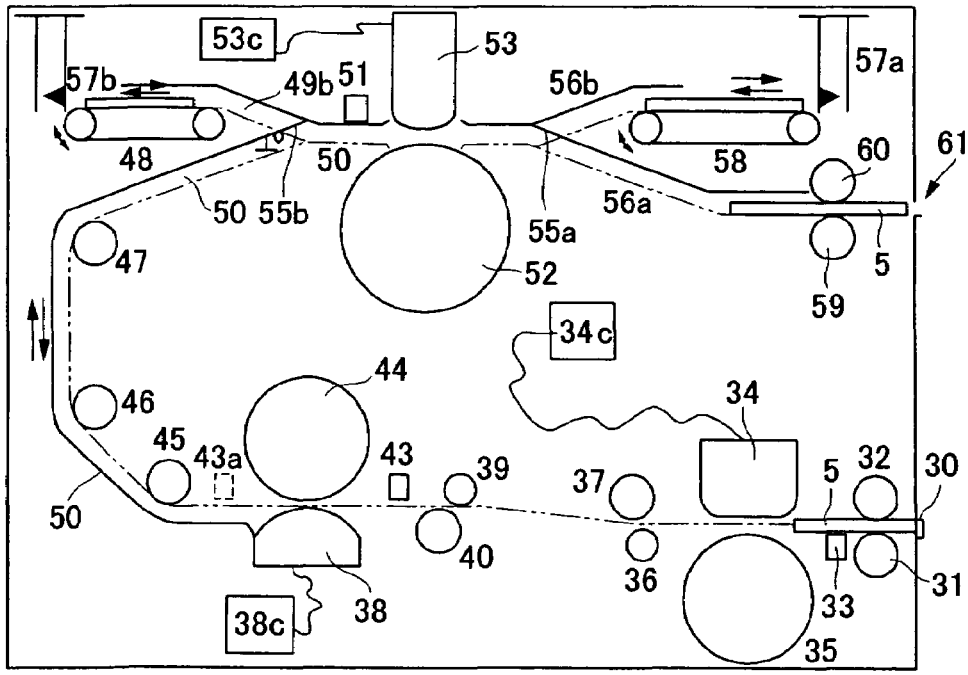
FIG. 20B schematically exemplifies an image processing apparatus.

In the image processing apparatus shown in FIG. 20B, the reversible thermosensitive recording medium 5, inserted from the entrance 30, progresses along the conveying root 50 shown by alternate long and short dash lines, alternatively progresses reversibly along the conveying root in the apparatus. The recording medium 5, inserted from the entrance 30, is conveyed in the apparatus by means of the conveying roller 31 and the guide roller 32. When it reaches at the pre-determined position on the conveying root 50, the existence is detected by means of sensor 33 and controlling device 34*c*, the magnetic thermosensitive layer is subjected to magnetic recording or erasing between the magnetic head 34 and the platen roller 35, then the recording medium passes between the guide roller 39 and the conveying roller 40, and is subjected to a heat treatment for erasing images between the ceramic heater 38, recognizing the existence by sensor 43 and operating through the ceramic heater controlling device 38*c*, and platen roller 44, then is conveyed along the conveying root 50 by means of conveying rollers 45, 46 and 47, is subjected to image forming between thermal head 53, recognizing the existence at a certain position by sensor 51 and operating through the thermal head controlling device 53*c*, and platen roller 52, and is discharged outside from conveying root 56*a* through exit 61 by means of conveying roller 59 and guide roller 60. By the way, the temperature of ceramic heater 38 may be properly set depending on the application, as explained earlier, the ceramic heater 38 is preferably set at 110° C. or more, more preferably 112° C. or more, most preferably 115° C. or more.

If desired, the recording medium 5 may be directed to conveying root 56*b* by switching the conveying root changing device 55*a*, recording medium 5 is subjected to the heat treatment again between thermal head 53 and platen roller 52, by means of conveying belt 58 which moves reversibly by the action of limit switch 57*a* which operates by a pressure of recording medium 5, then conveying through conveying root 49*b*, being connected by changing the conveying root changing device 55*b*, limit switch 57*b* and conveying belt 48 in order, and then is discharged outside from conveying root 56*a* through exit 61 by means of conveying roller 59 and guide roller 60.

Further, such blanched conveying root and conveying root changing device may be provided on both sides of the ceramic heater 38. In the case, sensor 43*a* is preferably provided between platen roller 44 and conveying roller 45.

In accordance with the image processing apparatus and image processing method, the erasing remainder due to repeated printings may be significantly reduced as well as the durability of the printed parts may be remarkably enhanced.

The examples of the present invention will be explained in the following, which are given for illustration of the invention and are not intended to be limiting thereof.

The number-average particle size and surface roughness were determined in the following ways.

<Number-Average Particle Size>

The number-average particle size of the inorganic fine particles was obtained by taking pictures of the inorganic fine particles by a transparent electron microscope (TEM), measuring the diameters of individual particles, and calculating the mean value.

<Surface Roughness>

The surface roughness was determined by observing the surface by means of Digital Microscope VK-8510 (by Keyence Co.) according to JIS B0610.

EXAMPLE 1

<Preparation of Reversible Thermosensitive Recording Medium>

—Preparation of Thermosensitive Layer

A composition comprised of 4.5 parts by mass of 3-diethylamino-6-methyl-7-anilinofluoran, 15 parts by mass of a coloring compound expressed by the following formula, and 61 parts by mass of 50 wt % solution of acrylpolyol (FR4754, by Mitsubishi Rayon K.K.) was milled and dispersed to 1.0 μm of particle size by means of a paint shaker. To the resulting dispersion, 20 parts by mass of adduct-type hexamethylenediisocyanate 75% by mass solution in ethyl acetate (Colonate HL, by Nippon Urethane K.K.) was added and stirred well to prepare a coating liquid for thermosensitive layer.

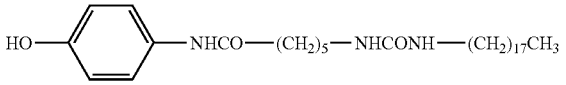

Then the resulting coating liquid for thermosensitive layer was coated on a white PET film 250 μm thick by means of a wire bar, dried at 100° C. for 1 minute, followed by heating at 60° C. for 24 hours, thereby a thermosensitive layer about 11 μm thick was provided.

—Preparation of Intermediate Layer—

1 part by mass of polyesterpolyol resin (Takelac U-21, by Takeda Chemical Industries LTD), 1 part by mass of zinc oxide (ZnO-305, by Sumitomo-Osaka Cement K.K.), 2 parts by mass of adduct-type hexamethylenediisocyanate 75% by mass solution in ethyl acetate (Colonate HL, by Nippon Polyurethane Industries Co.), and 9 parts by mass of methylethylketone (MEK) were stirred well to prepare a coating liquid for an intermediate layer.

Then the resulting coating liquid for intermediate layer was coated on the thermosensitive layer by means of a wire bar, dried at 90° C. for 1 minute, followed by heating at 70° C. for 2 hours, thereby an intermediate layer about 2.0 μm thick was provided.

—Preparation of Protective Layer—A composition comprised of 2 parts by mass of silica treated with organic silane compounds (Sailo Horbic 100, number-average particle size 1.4 μm, by Fuji Silysia LTD), 8 parts by mass of tris(acryloxyethyl)isocyanurate (FA-731A, by Hitachi Chemical Co.), 0.4 parts by mass of photopolymerization initiator (Irgacure 907, by Japan Chiba Gaigy Co.), 9 parts by mass of isopropylalcohol, and 9 parts by mass of toluene was shaken for 30 minutes to prepare a coating liquid for protective layer.

The resulting coating liquid for protective layer was coated on the above-noted intermediate layer by means of a wire bar, was heated and dried then passed with conveying velocity of 10 m/minute under the UV ray lamp of irradiation energy 80 W/cm to cure the coating, followed by heating at 60° C. for 24 hours, thereby a protective layer about 4 μm thick was provided.

As a result, the reversible thermosensitive recording medium according to the present invention was prepared.

EXAMPLE 2

<Preparation of Reversible Thermosensitive Recording Medium>

An reversible thermosensitive recording medium was prepared in the same manner with Example 1, except that the preparation of the protective layer was carried out as follows.

The surface roughness of the resulting recording medium was 1.4 μm.

—Preparation of Protective Layer—

A composition comprised of 2 parts by mass of silica treated with organic silane compounds (Sailo Horbic 100, number-average particle size 1.4 μm, by Fuji Silysia LTD), 4 parts by mass of tris(acryloxyethyl)isocyanurate (FA-731A, by Hitachi Chemical Co.), 2 parts by mass of dipentaerythritolhexaacrylate (DPHA, Nippon Kayaku Co.), 2 parts by mass of urethane acrylate oligomer (Art Resin UN-3320HA, by Negami Chemical Industrial Co.), 0.4 parts by mass of photopolymerization initiator (Irgacure 907, by Japan Chiba Gaigy Co.), 9 parts by mass of isopropylalcohol, and 9 parts by mass of toluene was stirred well to prepare a coating liquid for protective layer.

The resulting coating liquid for protective layer was coated on the above-noted intermediate layer by means of a wire bar, was heated and dried then passed with conveying velocity of 10 m/minute under the UV ray lamp of irradiation energy 80 W/cm to cure the coating, followed by heating at 60° C. for 24 hours, thereby a protective layer about 4 μm thick was provided.

EXAMPLE 3

<Preparation of Reversible Thermosensitive Recording Medium>

A reversible thermosensitive recording medium was prepared in the same manner with Example 1, except that the preparation of the protective layer was carried out as follows.

—Preparation of Protective Layer—

A composition comprised of 2 parts by mass of silica treated with organic silane compounds (Sailo Horbic 100, number-average particle size 1.4 μm, by Fuji Silysia LTD), 0.5 parts by mass of tris(acryloxyethyl)isocyanurate (FA-731A, by Hitachi Chemical Co.), 3.5 parts by mass of dipentaerythritolhexaacrylate (DPHA, Nippon Kayaku Co.), 4 parts by mass of urethane acrylate oligomer (Art Resin UN-3320HA, by Negami Chemical Industrial Co.), 0.4 parts by mass of photopolymerization initiator (Irgacure 907, by Japan Chiba Gaigy Co.), and 9 parts by mass of isopropylalcohol was stirred well to prepare a coating liquid for protective layer.

The resulting coating liquid for protective layer was coated on the above-noted intermediate layer by means of a wire bar, was heated and dried then passed with conveying velocity of 10 m/minute under the UV ray lamp of irradiation energy 80 W/cm to cure the coating, followed by heating at 60° C. for 24 hours, thereby a protective layer about 4 μm thick was provided.

EXAMPLE 4

<Preparation of Reversible Thermosensitive Recording Medium>

A reversible thermosensitive recording medium was prepared in the same manner with Example 2, except that the tris(acryloxyethyl)isocyanurate (FA-731A, by Hitachi Chemical Co.) was displaced by neopentylglycol modified trimethylolpropanediacrylate (R-604, Nippon Kayaku Co.) in the preparation of the protective layer.

EXAMPLE 5

<Preparation of Reversible Thermosensitive Recording Medium>

A reversible thermosensitive recording medium was prepared in the same manner with Example 2, except that the tris(acryloxyethyl)isocyanurate (FA-731A, by Hitachi Chemical Co.) was displaced by tetrahydrofurfurylacrylate (SR-285, by Sartomer K.K.) in the preparation of the protective layer.

EXAMPLE 6

<Preparation of Reversible Thermosensitive Recording Medium>

A reversible thermosensitive recording medium was provided by preparing the thermosensitive layer, intermediate layer, and protective layer in the same manner with Example 2, except that the silica treated with organic silane compounds (Sailo Horbic 100, number-average particle size 1.4 μm, by Fuji Silysia LTD) was displaced by super-fine silica treated with polymerizable organic silane compounds (No. 30, number-average particle size 4 μm, Mizusawa Industrial Chemicals, LTD) in the preparation of the protective layer.

EXAMPLE 7

<Preparation of Reversible Thermosensitive Recording Medium>

A reversible thermosensitive recording medium was provided in the same manner with Example 1, except that the preparation of the protective layer in Example 1 is replaced by the followings.

—Preparation of Protective Layer—

A composition comprised of 2 parts by mass of super-fine silica treated with organic silane compounds (R972, number-average particle size 16 nm, Japan Aerosil Co.), 4 parts by mass of dipentaerythritolhexaacrylate (DPHA, Nippon Kayaku Co.), 4 parts by mass of urethane acrylate oligomer (Art Resin UN-3320HA, by Negami Chemical Industrial Co.), 0.4 parts by mass of photopolymerization initiator (Irgacure 907, by Japan Chiba Gaigy Co.), 9 parts by mass of isopropylalcohol, and 9 parts by mass of toluene was stirred well to prepare a coating liquid for protective layer.

The resulting coating liquid for protective layer was coated on the above-noted intermediate layer by means of a wire bar, was heated and dried then passed with conveying velocity of 10 m/minute under the UV ray lamp of irradiation energy 80 W/cm to cure the coating, followed by heating at 60° C. for 24 hours, thereby a protective layer about 4 μm thick was provided.

EXAMPLE 8

<Preparation of Reversible Thermosensitive Recording Medium>

A reversible thermosensitive recording medium was provided in the same manner with Example 2, except that the silica treated with organic silane compounds (Sailo Horbic 100, number-average particle size 1.4 μm, by Fuji Silysia LTD) was displaced by super-fine silica treated with organic silane compounds (R972, number-average particle size 16 nm, Japan Aerosil Co.)

EXAMPLE 9

<Preparation of Reversible Thermosensitive Recording Medium>

A reversible thermosensitive recording medium was provided in the same manner with Example 2, except that the resulting coating liquid for protective layer was subjected to ultrasonic vibration by means of an ultrasonic apparatus (VS-100, by Azone Co.) at frequency 50 kHz for 10 minutes in the formation of the protective layer, thereafter the protective layer was prepared.

The resulting reversible thermosensitive recording medium has a surface roughness 0.6 μm.

EXAMPLE 10

<Preparation of Reversible Thermosensitive Recording Medium>

A reversible thermosensitive recording medium was provided in the same manner with Example 1, except that the preparation of the protective layer was carried out as follows.

—Preparation of Protective layer—

2 parts by mass of super-fine silica treated with organic silane compounds (R972, number-average particle size 16 nm, Japan Aerosil Co.), 4 parts by mass of tris(acryloxyethyl) isocyanurate (FA-731A, by Hitachi Chemical Co.), 2 parts by mass of dipentaerythritolhexaacrylate (DPHA, Nippon Kayaku Co.), 2 parts by mass of urethane acrylate oligomer (Art Resin UN-3320HA, by Negami Chemical Industrial Co.), 1 part by mass of UV curable silicone resin of 30% by mass solution (AY42-146-U10, by Toray Dow Corning Co.), 0.4 parts by mass of photopolymerization initiator (Irgacure 907, by Japan Chiba Gaigy Co.), 9 parts by mass of isopropylalcohol, and 9 parts by mass of toluene were stirred well to prepare a coating liquid for protective layer.

The resulting coating liquid for protective layer was coated on the above-noted intermediate layer by means of a wire bar, was heated and dried then passed with conveying velocity of 10 m/minute under the UV ray lamp of irradiation energy 80 W/cm to cure the coating, followed by heating at 60° C. for 24 hours, thereby a protective layer about 4 μm thick was provided.

EXAMPLE 11

<Preparation of Reversible Thermosensitive Recording Medium>

A reversible thermosensitive recording medium was prepared in the same manner with Example 2, except that the intermediate layer was not provided.

Further, the film that was coated with the thermosensitive layer was of milky-white; however, due to the UV crosslinking after coating the liquid for protective layer, the film was colored to pale red brown.

COMPARATIVE EXAMPLE 1

<Preparation of Reversible Thermosensitive Recording Medium>

A reversible thermosensitive recording medium was provided in the same manner with Example 7, except that the super-fine silica treated with organic silane compounds (R972, number-average particle size 16 nm, Japan Aerosil Co.) was displaced by amorphous silica with no silane treatment (Silysia 310P, number-average particle size 1.4 μm, by Fuji Silysia Chemical LTD) in the preparation of the protective layer of Example 7.

COMPARATIVE EXAMPLE 2

<Preparation of Reversible Thermosensitive Recording Medium>

A reversible thermosensitive recording medium was provided in the same manner with Example 2, except that the silica treated with organic silane compounds (Sailo Horbic 100, number-average particle size 1.4 μm, by Fuji Silysia LTD) was displaced by amorphous silica with no silane treatment (Silysia 310P, number-average particle size 1.4 μm, by Fuji Silysia Chemical LTD) in the preparation of the protective layer of Example 2.

COMPARATIVE EXAMPLE 3

<Preparation of Reversible Thermosensitive Recording Medium>

A reversible thermosensitive recording medium was provided in the same manner with Example 7, except that the silica treated with organic silane compounds (R972, number-average particle size 16 nm, Japan Aerosil Co.) was displaced by the silica treated with organic silane compounds (Sailo Horbic 100, number-average particle size 1.4 μm, by Fuji Silysia LTD) in the preparation of the protective layer of Example 7.

COMPARATIVE EXAMPLE 4

<Preparation of Reversible Thermosensitive Recording Medium>

—Preparation of Thermosensitive Layer—

A composition comprised of 4.5 parts by mass of 3-diethylamino-6-methyl-7-anilinofluoran, 15 parts by mass of coloring agent of the following formula, 3 parts by mass of silica treated with organic silane compounds (Sailo Horbic 100, number-average particle size 1.4 μm, by Fuji Silysia LTD), 61 parts by mass of 50% by mass solution of acrylpolyol (FR4754, by Mitsubishi Rayon K.K.) was milled and dispersed to 1.0 μm of particle size by means of a paint shaker. To the resulting dispersion, 20 parts by mass of adduct-type hexamethylenediisocyanate 75% by mass solution in ethyl acetate (Colonate HL, by Nippon Urethane K.K.) was added and stirred well to prepare a coating liquid for thermosensitive layer.

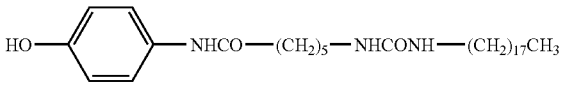

Then the resulting coating liquid for thermosensitive layer was coated on a white PET film 250 μm thick by means of a wire bar, dried at 100° C. for 1 minute, followed by heating at 60° C. for 24 hours, thereby a thermosensitive layer about 14 μm thick was provided.

Then an intermediate layer substantially same with Example 1 was provided on the thermosensitive layer, a protective layer substantially same with Comparative Example 1 was provided on the intermediate layer, thereby the reversible thermosensitive recording medium was prepared.

Then, the respective resulting recording media were subjected to the repetition durability procedure, and the maximum coloring density, erasing remainder, background smear, crazing and blowing trace were characterized as to the initial (as prepared) and after the repetition durability procedure.

<Repetition Durability Procedure>

With respect to the repetition durability procedure, the respective recording media prepared in Examples 1 to 11 and Comparative Examples 1 to 4 were punched into a credit-card shape, and were printed by means of Card Printer R-28000 (by Panasonic Communications K.K.) in a printing-erasing mode. In the printing-erasing mode, images are rewritten in a period between the insertion and discharge of the card, i.e. while the round trip. The erasing was carried out by means of a ceramic heater (erase bar), and the successive printing was carried out by means of a thermal head.

As for the condition, the printing energy was set to about 0.82 mJ/dot, the erasing energy on the ceramic heater was set at the central value of the region where an erasing remainder due to insufficient energy does not exist as well as the region where a fog due to excess energy does not appear. The printing density was determined in terms of black density by means of Macbeth Densitometer RD914.

The repetition durability procedure was carried out through manual operation considering the actual usage, the entire recording face of the respective recording media was touched by the finger thick after every printing, and the respective recording media were subjected to printing after 3 minutes repeatedly.

The maximum coloring density at initial printing and the maximum coloring density after 100 times of the repetition durability procedure were measured by means of Macbeth Densitometer RD914.

By the way, with respect to the object according to the present invention, both of the maximum coloring densities are more than 1.0. When the density was 1.0 or more, the result was expressed as "B", when the density was less than 1.0, the result was expressed as "D".

<Evaluation of Erasing Remainder>

The erasing remainder was evaluated on the respective recording media by the density difference, i.e. the difference between the density at the non-printing area prior to the printing and the density at the area where 100 times of repeated printing of solid letter and erasing thereof have been carried out and then the solid letter is erased. The erasing remainder is a measure of fusing and dissolving ingredients in the thermosensitive layer due to heating and platen pressure. With respect to the object according to the present invention, the erasing remainder is not detectable when the density difference is less than 0.03. Therefore, when the density difference was 0.03 or less, the result was expressed as "B", when the density difference was more than 0.03, the result was expressed as "D".

<Evaluation of Background Smear>

The background smear was evaluated on the respective recording media by the density difference, i.e. the difference between the density at the non-printing area prior to the printing and the density at the area where the thermal hysteresis was not induced at all during the repetition durability procedure. The background smear is a measure of tendency to adhere the oily smear on the recording medium. With respect to the object according to the present invention, the background smear is not detectable when the density difference is less than 0.03. Therefore, when the density difference was 0.03 or less, the result was expressed as "B", when the density difference was more than 0.03, the result was expressed as "D".

<Evaluation of Crazing>

The crazing was evaluated on the respective recording media by observing the appearance at the area where solid letters are printed 100 times repeatedly.

[Evaluation Standard]

A: no change on appearance

B: almost no change on surface appearance

C: slight crazing on printed letter (less than 1 mm length)

D: crack appears on solid printed area in 1 mm or more length

<Evaluation of Blowing Trace>

The blowing trace was evaluated on the respective recording media after subjecting to 100 times of repeated printing in which solid letter was printed at the every odd time and erasing pattern was printed at every even time, then observing the difference on appearance between the printed area and the adjacent with no thermal hysteresis other than due to the ceramic heater.

TABLE 1

| | Initial | | After 100 Times Repeated Printing | | | | | | | |
|---|---|---|---|---|---|---|---|---|---|---|
| | Maximum Coloring Density | EV | Maximum Coloring Density | EV | Erasing Remainder | EV | Backgroud Smear | EV | Crazing EV | Blowing Trace EV |
| Ex. 1 | 1.25 | B | 1.03 | B | 0.02 | B | 0.02 | B | B | C |
| Ex. 2 | 1.30 | B | 1.07 | B | 0.02 | B | 0.01 | B | B | B |
| Ex. 3 | 1.34 | B | 1.05 | B | 0.02 | B | 0.01 | B | C | C |
| Ex. 4 | 1.29 | B | 1.06 | B | 0.02 | B | 0.02 | B | B | B |
| Ex. 5 | 1.33 | B | 1.00 | B | 0.02 | B | 0.01 | B | B | B |
| Ex. 6 | 1.23 | B | 1.11 | B | 0.00 | B | 0.01 | B | A | A |
| Ex. 7 | 1.27 | B | 1.05 | B | 0.03 | B | 0.01 | B | B | A |
| Ex. 8 | 1.26 | B | 1.12 | B | 0.01 | B | 0.01 | B | A | A |
| Ex. 9 | 1.28 | B | 1.12 | B | 0.00 | B | 0.01 | B | A | B |
| Ex. 10 | 1.25 | B | 1.03 | B | 0.02 | B | 0.00 | B | B | A |
| Ex. 11 | 1.35 | B | 1.07 | B | 0.03 | B | 0.01 | B | B | C |
| Com. Ex. 1 | 1.30 | B | 0.93 | D | 0.07 | D | 0.05 | D | D | D |
| Com. Ex. 2 | 1.21 | B | 0.97 | D | 0.05 | D | 0.05 | D | B | B |
| Com. Ex. 3 | 1.25 | B | 1.04 | B | 0.07 | D | 0.02 | B | D | C |
| Com. Ex. 4 | 0.94 | D | 0.73 | D | 0.03 | B | 0.05 | D | D | B |

EV: Evaluation
[Evaluation Standard]
A: no boundary between the both areas.
B: slight difference on gloss
C: difference on gloss
D: occurrence of peel With respect to the results shown in Table 1, it is recognized that the amorphous silica in the protective layer that has not treated with organic silane compound leads to an inferior repetition durability from the results of Comparative Examples 1 and 2. Further, it is recognized that the protective layer without a reactive heterocyclic monomer leads to an inferior repetition durability from the results of Comparative Example 2.

The images provided by the recording medium of Comparative Example 4 were not uniform but rough and uneven. When the energy was increased still so as to raise the maximum coloring density, the protective layer was broken, consequently higher density was not obtainable.

On the contrary, the recording media of Examples 1 to 11 may respectively provide images with high coloring density without causing erasing remainder, background smear, crazing, and blowing trace.

The reversible thermosensitive recording medium according to the present invention may be applied to card articles such as pre-paid card, point card, and credit card. In the case of sheet, the area for printing is broader than a card; therefore, the recording medium may be applied to conventional documents or instructions for process management. Accordingly, the reversible thermosensitive recording medium according to the present invention may be broadly applied for a wider picture or various displays such as an entrance ticket, container for frozen-food, industrial product and sticker for various chemical container, and also for application such as physical distribution management and production process management.

What is claimed is:

1. A reversible thermosensitive recording medium comprising a support, a thermosensitive layer and a protective layer in order, wherein the thermosensitive layer comprises an electron-donating coloring compound and an electron-accepting compound and reversibly changes the color depending on temperatures, the protective layer comprises a reactive heterocyclic compound, and inorganic fine particles which have been treated to make the particles' surfaces at least partially hydrophobic, and the number-average particle size of the inorganic fine particles is 100 nm or less.

2. The reversible thermosensitive recording medium according to claim 1, wherein the reactive heterocyclic compound is at least one selected from the group consisting of reactive heterocyclic monomers and reactive heterocyclic oligomers.

3. The reversible thermosensitive recording medium according to claim 1, wherein the content or the reactive heterocyclic compound is 10 to 90% by mass based on the total mass of the reactive compounds.

4. The reversible thermosensitive recording medium according to claim 1, wherein the surfaces of the inorganic fine particles are treated using at least one agent selected from the group consisting of silane coupling agents, titanate coupling agents and aluminum coupling agents.

5. The reversible thermosensitive recording medium according to claim 4, wherein the silane coupling agent is comprised of an organic silane compound with a reactive unsaturated group.

6. The reversible thermosensitive recording medium according to claim 1, wherein the protective layer further comprises a silicone resin with a reactive group.

7. The reversible thermosensitive recording medium according to claim 1, wherein the protective layer is formed from a coating liquid for the protective layer after the coating liquid is exposed to ultrasonic.

8. The reversible thermosensitive recording medium according to claim 1, wherein the thermosensitive layer comprises a curable resin.

9. The reversible thermosensitive recording medium according to claim 1, wherein an intermediate layer is provided between the thermosensitive layer and the protective layer, and the intermediate layer comprises a UV ray absorber and a curable resin.

10. The reversible thermosensitive recording medium according to claim 1, wherein the surface roughness of the reversible thermosensitive recording medium is 0.2 μm or less.

11. The reversible thermosensitive recording medium according to claim 1, wherein the coefficient of kinetic friction of the reversible thermosensitive recording medium is 0.3 or less.

12. The reversible thermosensitive recording medium according to claim 1, wherein the reversible thermosensitive recording medium is formed into one of a card-like, label-like, sheet-like and roll-like configurations.

13. A reversible thermosensitive recording label comprising a reversible thermosensitive recording medium and one of an adhesive layer or tacky layer, wherein the recording medium comprises a support, a thermosensitive layer and a protective layer in order, the thermosensitive layer comprises an electron-donating coloring compound and an electron-accepting compound and reversibly changes the color depending on temperatures, the protective layer comprises a reactive heterocyclic compound, and inorganic fine particles which have been treated to make the particles' surfaces at least partially hydrophobic, one of the adhesive layer or tacky layer is disposed on the surface of the recording medium opposite to the image forming side, and the number-average particle size of the inorganic fine particles is 100 nm or less.

14. A reversible thermosensitive recording member comprising an information-memorizing part and a reversible displaying part, wherein the reversible displaying part comprises a reversible thermosensitive recording medium comprising a support, a thermosensitive layer and a protective layer in order, the thermosensitive layer comprises an electron-donating coloring compound and an electron-accepting compound and reversibly changes the color depending on temperatures, the protective layer comprises a reactive heterocyclic compound, and inorganic fine particles which have been treated to make the particles' surfaces at least partially hydrophobic, and the number-average particle size of the inorganic fine particles is 100 nm or less.

15. The reversible thermosensitive recording member according to claim 14, wherein the information-memorizing part and the reversible displaying part are integrated.

16. The reversible thermosensitive recording member according to claim 14, wherein the information-memorizing pan is selected from the group consisting of magnetic thermosensitive layer, magnetic stripe, IC memory, optical memory, hologram, RF-ID tag card, disc, disc cartridge and tape cassette.

17. An image processing apparatus comprising at least one of an image forming unit and an image erasing unit, wherein images are formed on a reversible thermosensitive recording medium by heating the reversible thermosensitive recording medium in the image forming unit, images are erased from a reversible thermosensitive recording medium by heating the reversible thermosensitive recording medium in the image erasing unit, and the reversible thermosensitive recording medium comprises a support, a thermosensitive layer and a protective layer in order, the thermosensitive layer comprises an electron-donating coloring compound and an electron-accepting compound and reversibly changes the color depending on temperatures, the protective layer comprises a reactive heterocyclic compound, and inorganic fine particles which have been treated to make the particles' surfaces at least partially hydrophobic, and the number-average particle size of the inorganic fine particles is 100 nm or less.

18. The image processing apparatus according to claim 14, wherein the image forming unit has one of a thermal head and a laser irradiation apparatus.

19. The image processing apparatus according to claim 14, wherein the image erasing unit comprises one selected from the group consisting of a thermal head, ceramic heater, heat roll, hot stamp, heat block and laser irradiation apparatus.

20. An image processing method comprising at least one of:

forming images on a reversible thermosensitive recording medium by heating the reversible thermosensitive recording medium, and erasing images from a reversible thermosensitive recording medium by heating the reversible thermosensitive recording medium;

wherein, the reversible thermosensitive recording medium comprises a support, a thermosensitive layer and a protective layer in order, the thermosensitive layer comprises an electron-donating coloring compound and an electron-accepting compound and reversibly changes the color depending on temperatures, the protective layer comprises a reactive heterocyclic compound, and inorganic fine particles which have been treated to make the particles' surfaces at least partially hydrophobic, and the number-average particle size of the inorganic fine particles is 100 nm or less.

21. The image processing method according to claim 20, wherein the image forming is carried out by one of thermal head and a laser irradiation apparatus.

22. The image processing method according to claim 20, wherein the image erasing is carried out by means of one selected from the group consisting of a thermal head, ceramic heater, heat roll, hot stamp, heat block and laser irradiation apparatus.

23. The image processing method according to claim 22, in which new images are formed along with erasing images by means of a thermal head.

* * * * *

UNITED STATES PATENT AND TRADEMARK OFFICE

CERTIFICATE OF CORRECTION

PATENT NO. : 7,585,813 B2
APPLICATION NO. : 11/805153
DATED : September 8, 2009
INVENTOR(S) : Hitoshi Shimbo et al.

It is certified that error appears in the above-identified patent and that said Letters Patent is hereby corrected as shown below:

On the title page, item [54] should read:

--(54) REVERSIBLE THERMOSENSITVE RECORDING MEDIUM, LABEL AND MEMBER, AND, IMAGE PROCESSING APPARATUS AND METHOD--.

Column 1, lines 1-4 should read:

-- REVERSIBLE THERMOSENSITVE RECORDING MEDIUM, LABEL AND MEMBER, AND, IMAGE PROCESSING APPARATUS AND METHOD--.

Signed and Sealed this

Twenty-first Day of September, 2010

David J. Kappos

David J. Kappos
*Director of the United States Patent and Trademark Office*